United States Patent [19]

Tamoto

[11] Patent Number: 4,927,743

[45] Date of Patent: May 22, 1990

[54] SILVER HALIDE PHOTOGRAPHIC LIGHT-SENSITIVE MATERIALS HAVING SPECIFIED COUPLER, DIR COUPLER AND SILVER COVERAGE

[75] Inventor: Koji Tamoto, Kanagawa, Japan

[73] Assignee: Fuji Photo Film Co., Ltd., Kanagawa, Japan

[21] Appl. No.: 160,971

[22] Filed: Feb. 26, 1988

[30] Foreign Application Priority Data

Feb. 27, 1987 [JP] Japan ..... 62-44789

[51] Int. Cl.[5] ..... G03C 1/46; G03C 1/06; G03C 7/32

[52] U.S. Cl. ..... 430/496; 430/505; 430/543; 430/544; 430/545; 430/556; 430/557

[58] Field of Search ..... 430/496, 505, 543, 544, 430/545, 556, 557

[56] References Cited

U.S. PATENT DOCUMENTS

| | | | |
|---|---|---|---|
| 4,192,681 | 3/1980 | Fujiwhara et al. | 430/373 |
| 4,391,884 | 7/1983 | Meyer et al. | 430/17 |
| 4,409,324 | 10/1983 | Ishikawa et al. | 430/546 |
| 4,584,264 | 4/1986 | Ohki et al. | 430/542 |
| 4,652,515 | 3/1987 | Ogawa et al. | 430/505 |
| 4,707,434 | 11/1987 | Koboshi et al. | 430/393 |
| 4,760,016 | 7/1988 | Hirabahashi et al. | 430/505 |

FOREIGN PATENT DOCUMENTS

| | | | |
|---|---|---|---|
| 192199 | 8/1986 | European Pat. Off. | 430/544 |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A silver halide color photographic light-sensitive material comprising a support having provided thereon one or more blue-sensitive layers each containing a yellow coupler, one or more green-sensitive layer each containing a magenta coupler, one or more red-sensitive layers each containing a cyan coupler, and one or more protective layers provided on the side of the support and further from the support than the color-sensitive layer which is furthest away from the support, the thickness of the total photographic layers provided on the support from the color-sensitive layer located closest to the support to the protective layers, inclusive, being 18 μm or less, wherein at least one of said yellow coupler is a compound represented by formula (I)

(I)

and wherein said color photographic light-sensitive material further contains a compound represented by formula (II)

(II)

Preferably at least one of the yellow, magenta and cyan couplers is incorporated by using a method of dispersion in which a solvent having a boiling point of 160° C. or more is used as the coupler dispersion medium and said coupler is dispersed in an amount such that the weight ratio of solvent to coupler is not more than 0.2, or incorporated by dispersing in a macromolecular polymer as the coupler dispersion medium.

10 Claims, No Drawings

SILVER HALIDE PHOTOGRAPHIC LIGHT-SENSITIVE MATERIALS HAVING SPECIFIED COUPLER, DIR COUPLER AND SILVER COVERAGE

FIELD OF THE INVENTION

This invention concerns multilayer silver halide color photographic light-sensitive materials in which the layers have been comparatively reduced in thickness over conventional materials and which have improved sharpness.

BACKGROUND OF THE INVENTION

Remarkable advancements have been made in the miniaturization and automation of camera equipment as a result of progress in the precision electronics industry. At the same time ever higher picture quality is required from sensitive materials and the level of performance demanded of the sensitive materials has now reached a very high level. Other factors influencing the course of development of the photographic art include todays preference for simplicity and speed, and the world-wise concern over the depletion of resources and the need for conservation of resources.

Many techniques are known for improving the sharpness of silver halide color photographic materials. One such technique involves reducing the amount of light which is scattered on striking the silver halide grains which are dispersed at random in a gelatin binder in the sensitive material. As disclosed in U.S. Pat. No. 3,409,433, for example, this method involves adding a colored material such as a dye to the silver halide emulsion layer or to a layer which is adjacent to the silver halide emulsion layer in order to absorb the light which is scattered by the silver halide grains. However, with methods of this type the light which should be absorbed by the silver halide grains is also absorbed and this is disadvantageous in that the speed of the light-sensitive emulsion layer is inevitably reduced.

Another technique involves the use of DIR couplers as disclosed, for example, in U.S. Pat. Nos. 3,227,554 and 4,248,962 and in Japanese patent application (OPI) Nos. 151944/82 and 217932/83 (the term "OPI" as used herein refers to a "published unexamined Japanese patent application"). In this case development inhibiting compounds are released by reaction with the oxidized form of the developing agent and sharpness is improved by an adjacency effect (edge effect) at the boundaries between exposed and unexposed areas. However, DIR couplers inhibit the development of both the layer to which they have been added and the adjacent layers and so they undesirably reduce the extent of color formation in the adjacent layers. Hence, if these compounds are used in large quantities the thickness of the light-sensitive material has to be increased since more silver halide or dye forming agent (coupler) must be used to adjust the tonality of the sensitive material and much effort is required to discover an appropriate method for the use of these materials.

Yet another technique which has been proposed as a means for improving sharpness involves reduction of the thickness of photographic emulsion layers and thereby the reduction of light scattering.

Thus, sharpness can be improved by reducing the layer thickness, by adding couplers to the developer beforehand and using external couplers to form a dye image during development, but this method is inappropriate for a coupler-incorporated type of sensitive material.

Needless to say in this case the thickness of the top layer furthest away from the support has an effect on the lower layers which are closer to the support.

Color photographic materials usually have the red, green and blue-sensitive layers coated in this order from the side closest to the support and a reduction in the thickness of the uppermost, blue-sensitive, layer is effective for improving sharpness.

The thickness of each layer of a multilayer silver halide color photographic material is determined principally by the amount of gelatin which is used for the medium, the amount of coupler used and the amount of high boiling point organic solvent which is used for dispersing the organic materials in the gelatin, and it is possible to reduce the layer thickness by reducing the amounts of these materials.

However, any reduction in the amount of coupler results in a reduction in color density and so the extent of any such reduction is obviously limited. However, there are methods in which the coupler volume is reduced by using low molecular weight couplers such as those as disclosed in Japanese patent application (OPI) No. 72243/86, but this reduces the fastness of the couplers to diffusion and may have an adverse effect since interaction with the silver halide grains is liable to occur in the emulsion layer and problems may also arise as a result of diffusion of the coupler within the layer.

On the other hand, any reduction of the amount of high boiling point organic solvent in which the organic materials are dispersed in the gelatin generally reduces the color forming potential of the couplers and may also result in a loss of stability of the dispersed couplers in the gelatin film and this is disadvantageous in that precipitation may occur in either the emulsified material or the coated film. Furthermore, with some couplers any reduction in the amount of high boiling point organic solvent may result in a marked reduction in the stability of the dyes from which the image is formed after development.

Reducing the amount of gelatin is the most effective way of reducing layer thickness but any reduction in the amount of gelating which functions s a binder results in marked changes in the properties of the gelatin film and is disadvantageous in that it leads to a deterioration of the film quality. Thus, in terms of the dynamic properties it results in a lowering of the elastic modulus and it also leads to problems with poor retention of the dispersed organic materials (sweating) in the light-sensitive layer under conditions of high temperature and humidity because of the reduced amount of binder. The improvement of sharpness by simply reducing the thickness of the material (reducing layer thickness) in this way can only be carried out within the limitations described above and it has not been possible to achieve really satisfactory results in this way.

SUMMARY OF THE INVENTION

An objective of the present invention is to provide multilayer silver halide color photographic light-sensitive materials characterized by reduction in layer thickness which thus have improved sharpness. Furthermore, the deterioration in film quality of the sensitive material which conventionally accompanies reduction in layer thickness is to be prevented.

As a result of thorough research the inventors have discovered that the aforementioned objective can be realized by means of a multilayer silver halide color photographic light-sensitive material, in which one or more blue-sensitive layers which contain a yellow coupler, green-sensitive layers which contain a magenta coupler, and red-sensitive layers which contain a cyan coupler are established on a support and a protective layer is established at a position further away from the support than the color-sensitive layer which is furthest away from the support, the thickness in the dry state from said protective layer to the color-sensitive layer which is located closest to the support, inclusive of said protective and closest color-sensitive layer, is less than 18 μm, that said yellow coupler is a compound represented by the general formula (I) and, moreover, that a compound represented by the general formula (II) is included in said light-sensitive material.

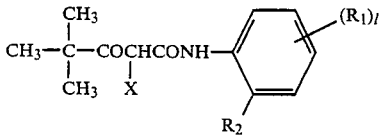

(I)

In formula (I), $R_1$ represents a halogen atom, an aliphatic group, an aromatic group, an aliphatic oxy group, an aromatic oxy group, a carboxylamido group, a sulfonamido group, a carbamoyl group, a sulfamoyl group, an acyloxy group, a substituted amino group, an aliphatic thio group, a ureido group, a sulfamoylamino group, a cyano group, an aliphatic oxycarbonyl group, an aliphatic oxycarbonylamino group, an imido group, an aliphatic sulfonyl group, an aromatic sulfonyl group, or a heterocyclic group. $R_2$ represents a hydrogen atom, a halogen atom, or an aliphatic oxy group. X represents a hydrogen atom or a group which is eliminated by a coupling reaction with the oxidized form of a primary aromatic amine based developing agent. l represents an integer of value 0 to 4.

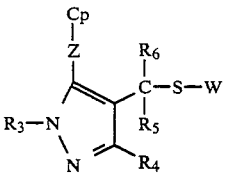

(II)

In general formula (II), Cp represents a coupling component which is able to react with the oxidized form of a primary aromatic amine based developing agent. $R_3$ represents a hydrogen atom, an alkyl group, an aryl group, an acyl group, a sulfonyl group, an alkoxycarbonyl group, or a heterocyclic group. $R_4$ represents a hydrogen atom, an alkyl group, an aryl group, an alkoxy group, an amino group, a carboxylamido group, a sulfonamido group, a carboxyl group, an alkoxycarbonyl group, a carbamoyl group, or a cyano group. $R_5$ and $R_6$ individually represent hydrogen atoms, alkyl groups or aryl groups. W represents a group which forms, together with the sulfur atom when the thioether bond is eliminated, a compound which has as a development inhibiting action.

Z is bonded to the coupling position of Cp and represents an —O— group, an —S— group or an

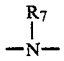

group, where $R_7$ represents a hydrogen atom, an alkyl group, an acyl group or a sulfonyl group.

In a preferred embodiment of the silver halide color photographic material of the present invention, at least one of the yellow, magenta and cyan couplers mentioned above is incorporated by dispersion using a dispersion method as described in (i) or (ii) below:

(i) a dispersion method in which a high boiling point solvent as the coupler dispersion medium is dispersed in an amount such that the weight ratio with respect to the coupler is not more than 0.2;

(ii) a dispersion method by means of a polymer dispersion in which a macromolecular polymer (polymer) is used as the coupler dispersion medium.

It is preferred in the silver halide color photographic light-sensitive materials according to the present invention that the amount of silver contained in the light-sensitive material is 5.5 g/m$^2$ or less.

In a particularly preferred embodiment of the silver halide color photographic light-sensitive materials of the present invention, the above-mentioned cyan coupler can be represented by the general formula (III).

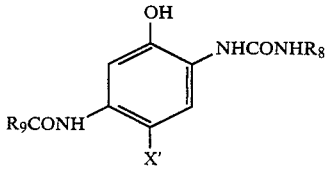

(III)

wherein $R_8$ represents an aryl group or a heterocyclic group and $R_9$ represents a ballast group. X' represents a hydrogen atom or a group which can be eliminated by means of a coupling reaction with the oxidized form of a primary aromatic amine based developing agent.

Thus, the inventors have markedly reduced the layer thickness by using a 2-equivalent yellow coupler of general formula (I) and a development inhibitor releasing compound (DIR compound) of general formula (II) and thereby achieved an improvement in sharpness. The possibility of reducing the layer thickness in this way arose out of the discovery of a technique in which use is made of the fact that a level of performance greater than that obtained by simply combining the performances of the yellow couplers and the DIR compounds of this invention can be achieved in this way. When the DIR compounds of this invention are used and the amounts of silver halide, coupler and gelatin are reduced to provide an adequate reduction in layer thickness relative to that of the conventional thickness of multilayer silver halide light-sensitive materials there is a marked improvement in sharpness and, contrary to expectation, very little worsening of the granularity. These unexpected results were discovered while following up the reduction of layer thickness for improving sharpness as in this invention by increasing the iodine content of the silver halide in order to increase sensitivity and picture quality and the amount of the DIR compound used was also increased and the increase in the effect with respect to the increase of the amount used reached saturation. When adequate reduction in layer thickness was achieved by reducing the amounts of gelatin binder and silver halide the development inhibiting effects of the DIR compounds of this invention are delayed and by making use of this characteristic feature the invention is possible without losing color reproducibility.

It is usually observed that the film properties of conventional sensitive materials deteriorate when the layer thickness is reduced and various problems arise, especially in the layers which are close to the surface of the sensitive material; however, by using the yellow couplers of the present invention and a method in which at least the yellow coupler out of the yellow, magenta and cyan couplers and the other organic materials is dispersed in a small amount of high boiling point organic solvent or using a method of polymer dispersion has now been discovered that it is possible to reduce the layer thickness while retaining the oil-soluble components in the gelatin binder and, moreover, while maintaining the film strength and without deterioration of film quality. Furthermore, phenol based cyan couplers which have a p-cyanophenylureido group in the 2-position and an acylamino group in the 5-position which have poor color restoration and excellent colored image storage properties are known (U.S. Pat. No. 4,333,999), but any reduction of the amount of high boiling point organic solvent made to provide a reduction in layer thickness has a considerable effect on the storage properties and makes these materials difficult to use. This problem can be overcome, however, by means of the cyan couplers of this invention.

DETAILED DESCRIPTION OF PREFERRED EMBODIMENTS

The yellow couplers which are used in the invention are 2-equivalent α-acylacetamide based yellow couplers and they can be represented by the general formula (I) indicated above.

In formula (I), $R_1$ may be, for example, a halogen atom (for example, a fluorine atom, a chlorine atom, a bromine atom), an aliphatic group which has from 1 to 40 carbon atoms, an aromatic group which has from 6 to 40 carbon atoms, an aliphatic oxy group which has from 1 to 40 carbon atoms, an aromatic oxy group which has from 6 to 40 carbon atoms, a carboxylamido group which has from 2 to 40 carbon atoms, a sulfonamido group which has from 1 to 40 carbon atoms, a carbamoyl group which has from 1 to 40 carbon atoms, a sulfamoyl group which has from 0 to 40 carbon atoms, an acyloxy group which has from 2 to 40 carbon atoms, a substituted amino group which has from 2 to 40 carbon atoms, an aliphatic thio group which has from 1 to 40 carbon atoms, a ureido group which has from 0 to 40 carbon atoms, a sulfamoylamino group which has from 0 to 40 carbon atoms, a cyano group, an aliphatic oxycarbonyl group which has from 2 to 40 carbon atoms, an aliphatic oxycarbonylamino group which has from 2 to 40 carbon atoms, an imide group which has from 4 to 40 carbon atoms, an aliphatic sulfonyl group which has from 1 to 40 carbon atoms, an aromatic sulfonyl group which has from 6 to 40 carbon atoms, or a heterocyclic group which has from 1 to 40 carbon atoms.

$R_2$ is a hydrogen atom, a halogen atom (for example, a fluorine atom, a chlorine atom or a bromine atom) or an aliphatic oxy group which has from 1 to 40 carbon atoms.

X is a group which can be eliminated by a coupling reaction with the oxidized form of a primary aromatic amine developing agent and more precisely it is a group which can be represented by general formulae (IV), (V) or (VI) as indicated below.

$$-O-R_{10} \quad \text{(IV)}$$

$$-S-R_{11} \quad \text{(V)}$$

(VI)

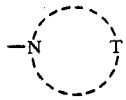

$R_{10}$ in general formula (IV) is an aromatic group which has from 6 to 40 carbon atoms, a heterocyclic group which has from 1 to 40 carbon atoms, an acyl group which has from 2 to 40 carbon atoms, an aliphatic sulfonyl group which has from 1 to 40 carbon atoms or an aromatic sulfonyl group which has from 6 to 40 carbon atoms.

$R_{11}$ in general formula (V) is an aliphatic group which has from 1 to 40 carbon atoms, an aromatic group which has from 6 to 40 carbon atoms or a heterocyclic group which has from 1 to 40 carbon atoms.

T in general formula (VI) represents a non-metallic atomic group which must form a 5- to 7-membered single or condensed heterocyclic ring with the nitrogen. Examples of heterocyclic rings which can be formed by N and T include pyrrole, pyrazole, imidazole, 1,2,4-triazole, tetrazole, indole, indazole, benzimidazole, benzotriazole, tetraazaindene, succinimide, phthalimide, saccharin, oxazolidine-2,4-dione, imidazolidine-2,4-dione, thiazolidine-2,4-dione, urazole, parabanic acid, maleinimide, 2-pyridone, 4-pyridone, 6-pyridazone, 6-pyrimidone, 2-pyrazone, 1,3,5-triazine-2-one, 1,2,4-triazine-6-one, 1,3,4-triazine-6-one, 2-oxazolone, 2-thiazolone, 2-imidazolone, 3-isooxazolone, 5-tetrazolone, 1,2,4-triazo-5-one, etc., and moreover these heterocyclic groups may be substituted with substituents such as, for example, halogen atoms, hydroxyl groups, nitro groups, cyano groups, aliphatic groups, aromatic groups, heterocyclic groups, aliphatic oxy groups, aromatic oxy groups, aliphatic thio groups, aromatic thio groups, aliphatic oxycarbonyl groups, carboxylamido groups, sulfonamido groups, carbamoyl groups, sulfamoyl groups, ureido groups, sulfamoylamino groups, aliphatic oxycarbonylamino groups, substituted amino groups, etc.

The aliphatic groups in this invention may be linear chain, branched chain or cyclic alkyl groups, alkenyl groups or alkynyl groups and these groups may have substituents. Examples of such aliphatic groups include a methyl group, an ethyl group, an isopropyl group, an n-butyl group, a t-butyl group, a t-amyl group, an n-hexyl group, a cyclohexyl group, an n-octyl group, a 2-ethylhexyl group, an n-decyl group, an n-dodecyl group, an n-tetradecyl group, an n-hexadecyl group, a 2-hexyldecyl group, an n-octadecyl group, allyl groups, a benzyl group, phenethyl groups, undecenyl groups, octadecenyl groups, a trifluoromethyl group, chloroethyl groups, cyanoethyl groups, a 1-(ethoxycarbonyl-)ethyl group, methoxyethyl groups, butoxyethyl groups, a 3-dodecyloxypropyl group, phenoxyethyl groups, etc. The heterocyclic groups in this invention may be substituted or unsubstituted single ring or condensed ring heterocyclic groups and these include, for example, 2-furyl groups, 2-thienyl groups, 2-pyridyl groups, 3-pyridyl groups, 4-pyridyl groups, 2-quinolyl groups, oxazol-2-yl groups, thiazol-2-yl groups, benzoxazol-2-yl groups, benzothiazol-2-yl groups, 1,3,4-thiadiazol-2-yl groups, 1,3,4-oxadiazol-2-yl groups, etc., as well as the groups derived from the aforementioned compounds indicated for

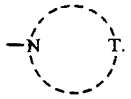

The aromatic groups in this invention may be substituted or unsubstituted single ring or condensed ring aryl groups such as phenyl groups, tolyl groups, 4-chlorophenyl groups, 4-methoxyphenyl groups, 1-naphthyl groups, 2-naphthyl groups, 4-t-butylphenoxy groups, etc.

Examples of preferred substituents for the couplers represented by the general formula (I) which are used in the invention are indicated below.

Thus, $R_1$ is preferably an aliphatic group (e.g., a methyl group, an ethyl group, an n-propyl group, a t-butyl group, etc.), an aliphatic oxy group (e.g., a methoxy group, an ethoxy group, an n-butoxy group, an n-dodecyloxy group, etc.), a halogen atom (e.g., a fluorine atom, a chlorine atom, a bromine atom), a carboxylamido group (e.g., an acetamido group, an n-butanamido group, an n-tetradecylamido group, a benzamido group, etc.), a sulfonamido group (e.g., a methylsulfonamido group, an n-butylsulfonamido group, an n-octylsulfonamido group, an n-dodecylsulfonamido group, a toluenesulfonamido group, etc.), an aliphatic oxycarbonyl group (e.g., a methoxycarbonyl group, an ethoxycarbonyl group, an n-butoxycarbonyl group, an n-hexyloxycarbonyl group, a 2-ethylhexyloxycarbonyl group, a 1-(ethoxycarbonyl)ethyloxycarbonyl group, a 2-butoxyethyloxycarbonyl group, a 3-dodecyloxypropyloxycarbonyl group, an n-decyloxycarbonyl group, an n-dodecyloxycarbonyl group, a phenethyloxycarbonyl group, etc.) or a carbamoyl group (a dimethylcarbamoyl group, a dibutylcarbamoyl group, a dibenzylcarbamoyl group, a di-2-ethylhexylcarbamoyl group, an n-dodecylcarbamoyl group, etc.).

$R_2$ is preferably a chlorine atom or an aliphatic oxy group (e.g., a methoxy group, an ethoxy group, a methoxyethoxy group, an n-octyloxy group, a 2-ethylhexyloxy group, an n-tetradecyloxy group, etc.).

X is preferably a group in which $R_8$ in general formula (IV) is an aromatic group (e.g., a 4-p-hydroxyphenylsulfonylphenoxy group, a 4-p-benzyloxyphenylsulfonylphenoxy group, a 4-cyanophenoxy group, a 4-dimethylsulfamoylphenoxy group, a 4-isopropyloxycarbonylphenoxy group, a 4-ethoxycarbonyl-2-methylsulfonamidophenoxy group, etc.) or a group which is represented by the general formula (VI), and most preferably those which can be represented by the general formula (VII).

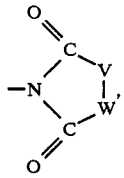

(VII)

In general formula (VII), V represents a substituted or unsubstituted methylene group or a substituted or unsubstituted imino group and W' represents an oxygen atom, a sulfur atom, a substituted or unsubstituted methylene group or a substituted or unsubstituted imino group. However, W' cannot be either an oxygen atom or a sulfur atom when V is an imino group. Examples of groups which can be represented by the general formula (VII) include a succinimido group, a phthalimido group, a 5-hexyloxy-1-methylimidazolidine-2,4-dione-3-yl group, a 5-ethoxy-1-benzylimidazolidine-2,4-dione-3-yl group, a 5-ethoxy-1-methylimidazolidine-2,4-dione-3-yl group, a 5-dodecyloxy-1-benzylimidazolidine-2,4-dione-3-yl group, a 5,5-dimethyloxazolidine-2,4-dione-3-yl group, a 1-benzyl-2-benzyltriazolidine-3,5-dione-4-yl group, a 1-benzyl-2-phenyltriazolidine-3,5-dione-4-yl group, a 1-n-propyl-2-phenyltriazolidine-3,5-dione-4-yl group, etc.

The yellow couplers represented by the general formula (I) may take the form of dimers, trimers or tetramers with the substituents $R_1$, $R_2$ or X functioning as di-, tri- or tetravalent groups, but monomers or dimers are preferred.

Methods for the synthesis of the α-acylacetamide based yellow couplers which are used in the invention are disclosed in U.S. Pat. Nos. 3,973,968, 4,314,023, 4,057,432 and 4,404,274 which are each incorporated herein by reference.

Typical examples of the 2-equivalent α-acylacetamide based yellow couplers used in the invention are indicated below.

Y-1

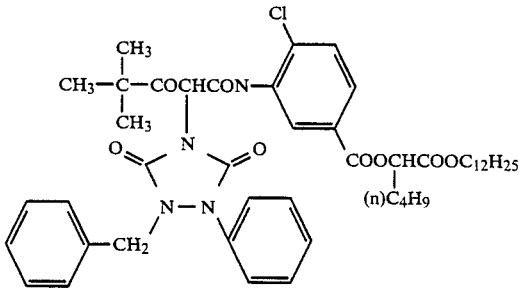

-continued
Y-2
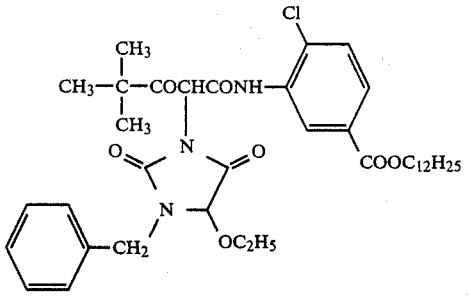
Y-3
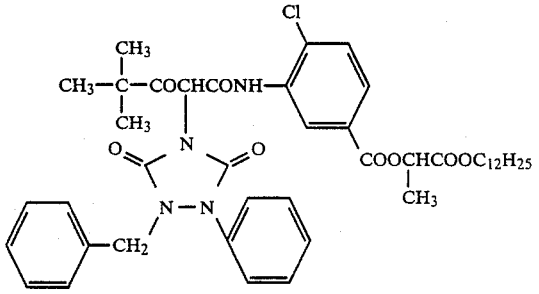
Y-4
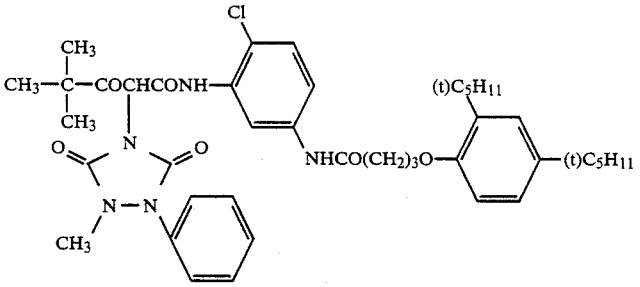
Y-5
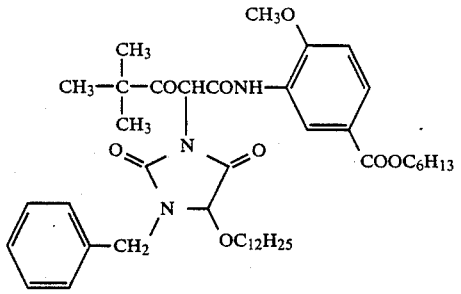
Y-6
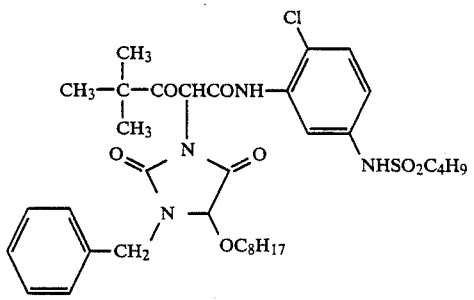

-continued
Y-7
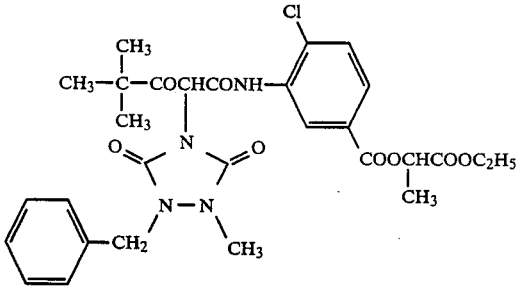
Y-8
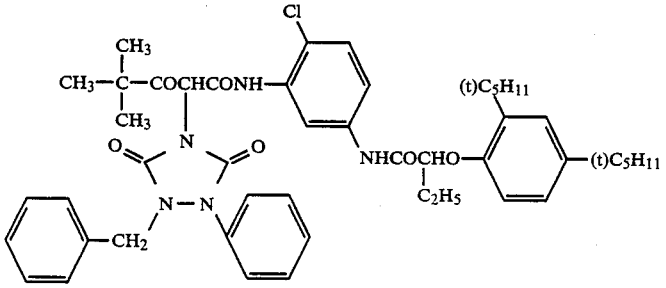
Y-9
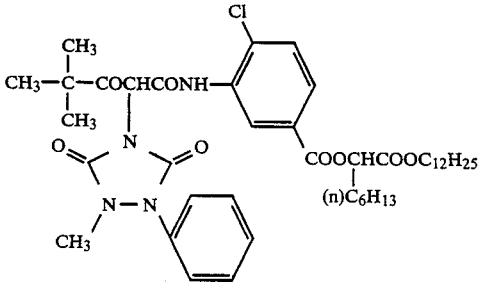
Y-10
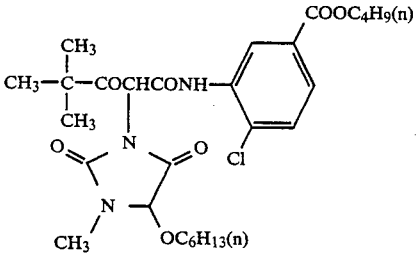
Y-11
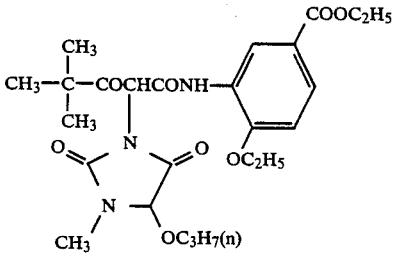
Y-12
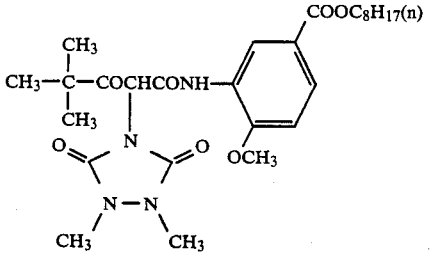

-continued
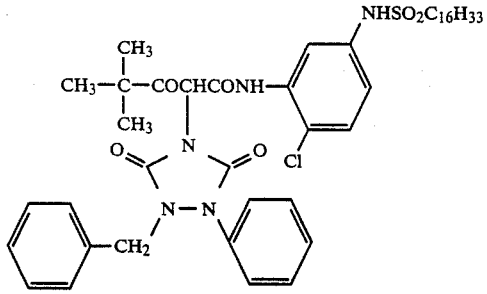
Y-13
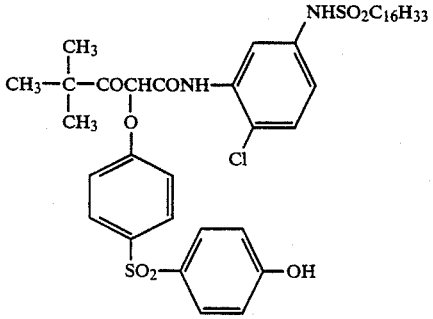
Y-14
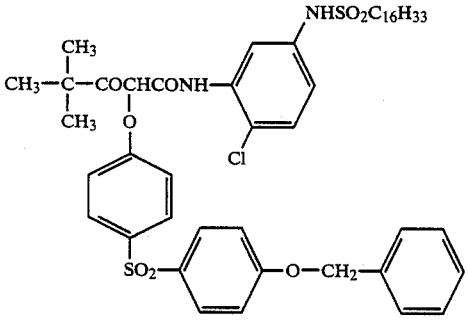
Y-15
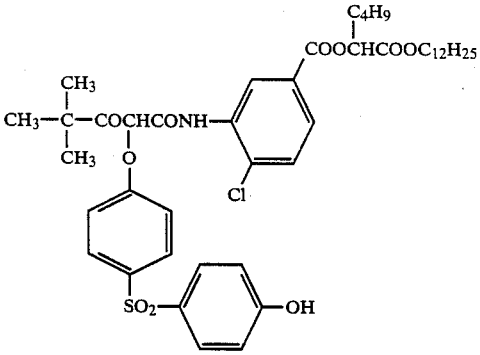
Y-16
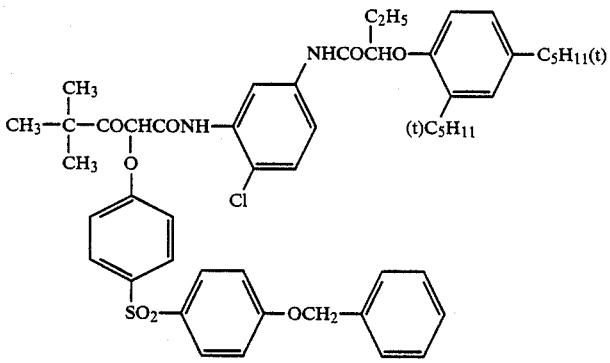
Y-17

-continued

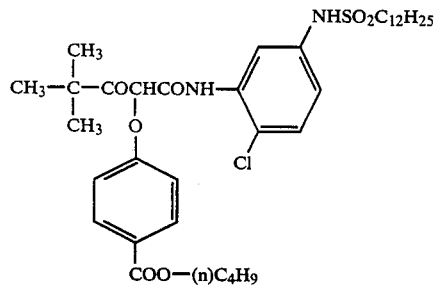

Y-18

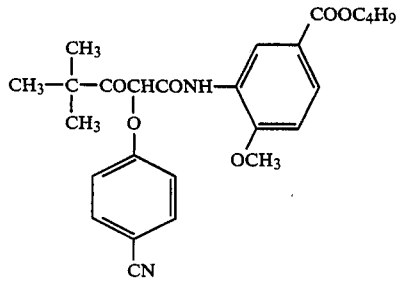

Y-19

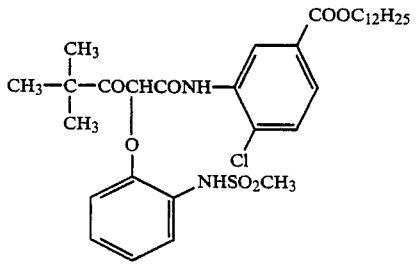

Y-20

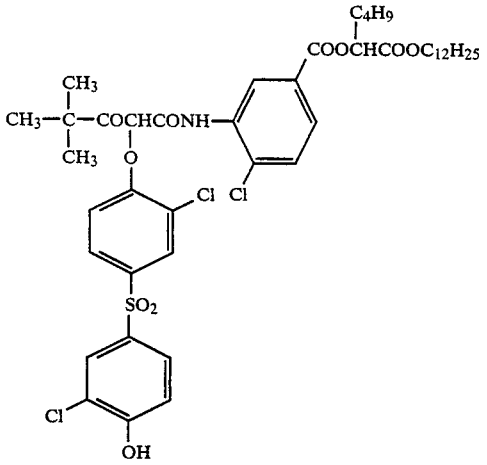

Y-21

The 2-equivalent α-acylacetamide based yellow couplers of this invention can be included in the silver halide color sensitive material either individually or in the form of mixtures of two or more. The amount added is from 1 to 50 mol % per mol of silver halide in said layer when it is added to an emulsion layer or from 1 to 50 mol % per mol of silver halide in the layer adjacent to said layer when it is added to a layer which does not contain silver halide. The addition can be made using the normal methods.

The above-mentioned general formula (II) will now be described in greater detail.

In formula (II) Cp represents a coupling component which can react with the oxidized form of a primary amine based developing agent. The coupling product of Cp may be a colored dye or it may be a compound which has no absorption maxima in the visible range (400 to 700 nm). In cases where a colored dye is formed this may be fast to diffusion or it may be diffusible to the extent that it has some mobility. Furthermore, it may form a dye with solubilizing groups which can be washed out in the developer. $R_3$ is a hydrogen atom, an alkyl group, an aryl group, an acyl group, a sulfone group, an alkoxycarbonyl group or a heterocyclic residue. $R_4$ is a hydrogen atom, an alkyl group, an aryl group, an alkoxy group, an amino group, an acid amido group, a sulfonamido group, a carboxyl group, an alkoxycarbonyl group, a carbamoyl group or a cyano group.

$R_5$ and $R_6$ are hydrogen atoms, alkyl groups or aryl group.

Z is bonded to the coupling position of the Cp group and represents an —O— group, an —S— group or an

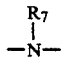

group where $R_7$ is a hydrogen atom, an alkyl group, an acyl group or a sulfonyl group.

W in formula (II) is a group which forms, together with the sulfur atom when the sulfur atom of the thioether bond is eliminated, a compound which has a development inhibiting action, for example, an arylmercapto compound, a heterocyclic compound, a thioglycolic acid type compound, cysteine, glutathione, etc. For example, typical mercapto compounds for W include heterocyclic type mercapto compounds, such as mercaptotetrazole based compounds, especially 1-phenyl-2-mercaptotetrazole, 1-nitrophenyl-5-mercaptotetrazole, 1-naphthyl-5-mercaptotetrazole, 1-methyl-5-mercaptotetrazole, 1-ethyl-5-mercaptotetrazole, etc., or mercaptothiazole based compounds, especially 2-mercaptobenzothiazole, mercaptonaphthothiazole, etc., or mercaptooxadiazole based compounds, mercaptopiperidine based compounds, mercaptothiadiazole based compounds, especially 2-mercaptothiadiazolotriazine, etc., or mercaptotriazine based compounds, mercaptotriazole based compounds and mercaptobenzene based compounds, especially 1-mercapto-2-benzoic acid, 1-mercapto-2-nitrobenzene, 1-mercapto-3-heptadecanoylaminobenzene, etc.

The compounds represented by the general formula (II) can be synthesized using, for example, the methods disclosed in Japanese Patent Application (OPI) Nos. 56837/82 and 114946 (U.S. Pat. No. 4,409,323).

Preferred examples of the compounds which can be represented by the general formula (II) are indicated below.

D-1

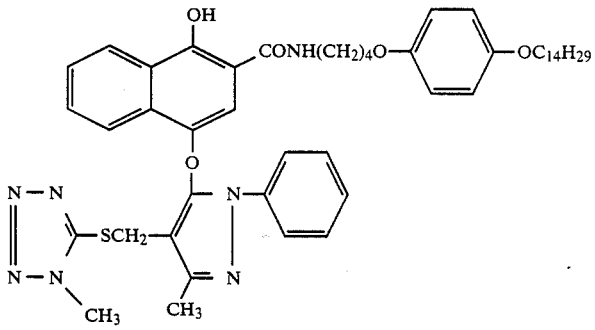

D-2

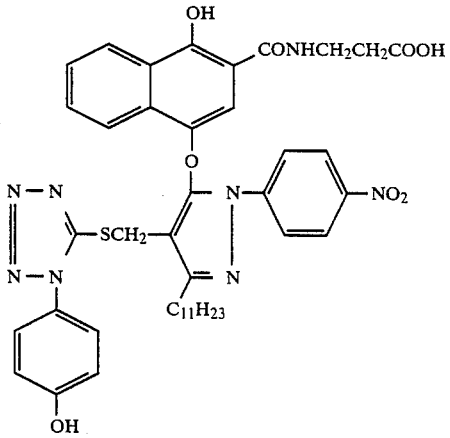

-continued
D-3
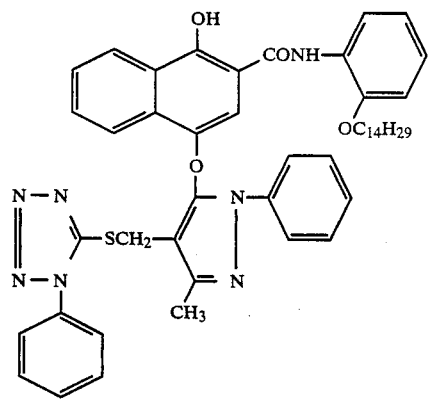
D-4
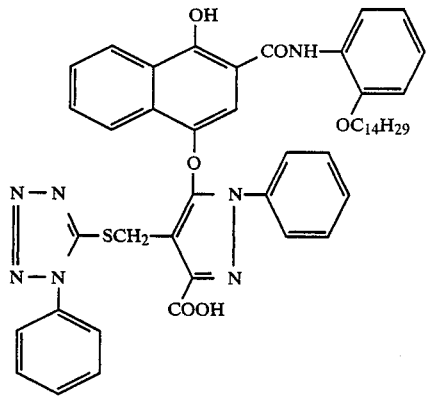
D-5
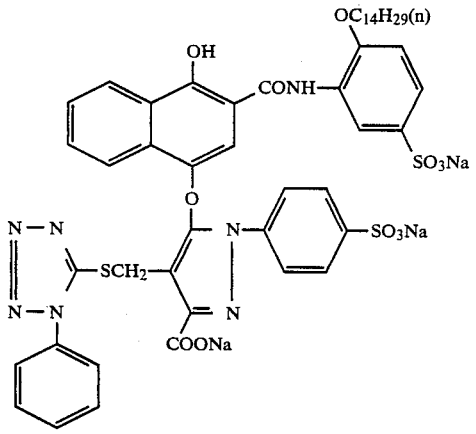
D-6
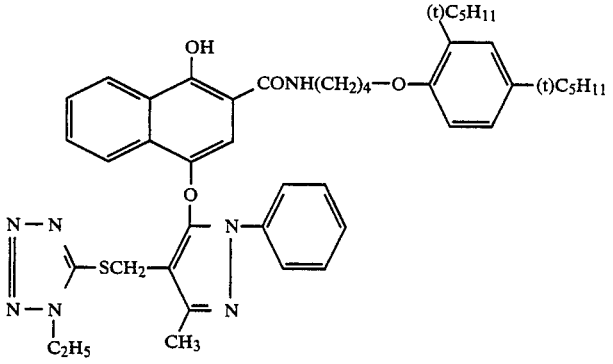

-continued
D-7
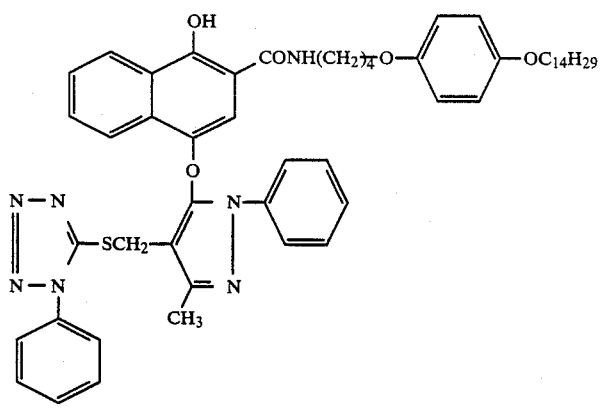
D-8
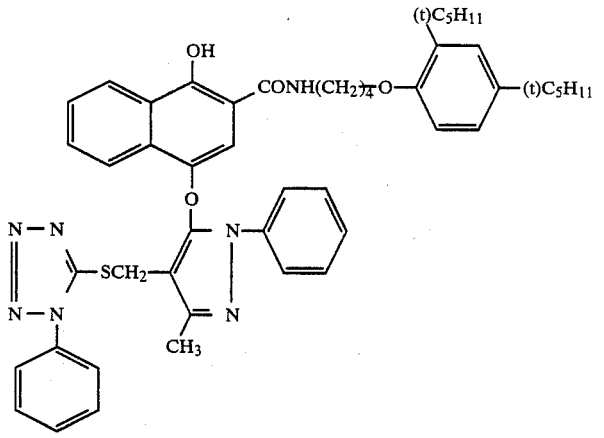
D-9
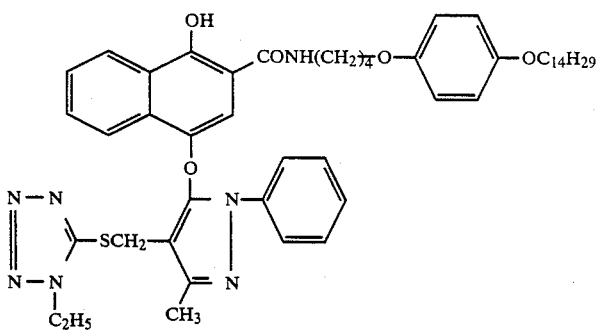
D-10
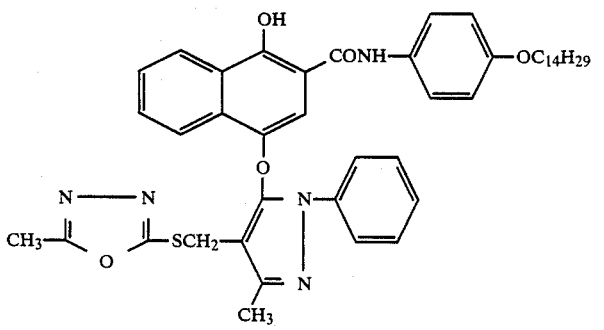

-continued

D-11

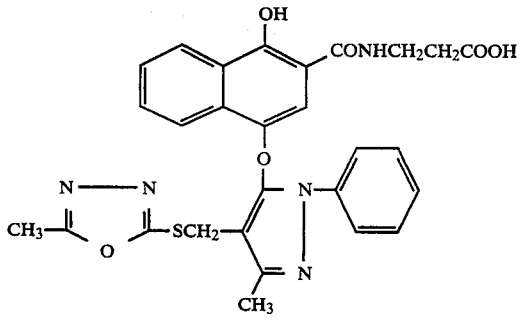

D-12

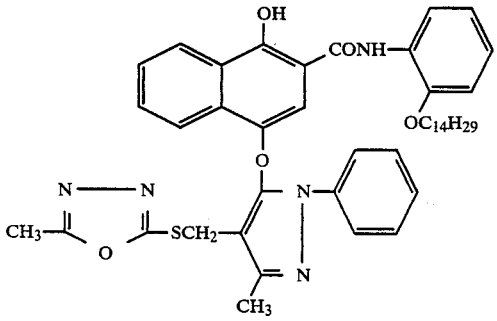

The methods for the dispersion of the couplers in this invention are described in detail below. The first is (i) a dispersion method in which a high boiling point solvent as the coupler dispersion medium is dispersed in an amount such that the weight ratio with respect to the coupler is not more than 0.2, and the second is (ii) a dispersion method by means of a polymer dispersion in which a macromolecular polymer (polymer) is used as the coupler dispersion medium.

The high boiling point organic solvent which forms the dispersion medium used in dispersion method (i) is essentially water-insoluble and has a boiling point of at least about 160° C. Those which are used generally in the photographic industry such as those disclosed in U.S. Pat. No. 2,322,027 can be used for this purpose.

Examples of suitable high boiling point organic solvents include phthalate esters (e.g., dibutyl phthalate, dicyclohexyl phthalate, di-2-ethylhexyl phthalate, decyl phthalate, etc.), phosphoric acid or phosphonic acid esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexyl phenylphosphonate, etc.), benzoate esters (e.g., 2-ethylhexyl benzoate, dodecyl benzoate, 2-ethylhexyl-p-hydroxybenzoate, etc.), amides (e.g., diethyldodecanamide, N-tetradecylpyrrolidone, etc.), alcohols or phenols (e.g., isostearyl alcohol, 2,4-di-tertamylphenol, etc.), aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

The method of emulsification in this case is an oil in water dispersion method and, after forming a solution in either the aforementioned high boiling point organic solvent or a low boiling point, so-called auxiliary solvent or in a mixture of both, the material is finely dispersed in an aqueous medium such as water, an aqueous gelatin solution, etc., in the presence of a surfactant. Organic solvents of boiling point at least about 30° C. and preferably of boiling above 50° C. but below about 160° C. can be used for the auxiliary solvent. Typical examples of auxiliary solvents include ethyl acetate, butyl acetate, ethyl propionate, methyl ethyl ketone, cyclohexanone, 2-ethoxyethyl acetate, dimethylformamide, etc. The dispersion may be accompanied by phase reversal, and the dispersion can be used for coating after the removal or partial removal of the auxiliary solvent as required by distillation, noodle washing, or ultrafiltration, etc.

The weight ratio of the high boiling point organic solvent to the coupler is not more than 0.2 and preferably not more than 0.1, and the most desirable state is that of an oil free emulsion which essentially contains no high boiling point organic solvent.

In the second dispersion method (ii) a polymer is used as the dispersion medium in place of the high boiling point organic solvent used in (i). For example, there is the method in which a vinyl monomer and a hydrophobic couple are dissolved in a low boiling point solvent and emulsified as disclosed in Japanese Patent Publication No. 30494/73. Other methods are disclosed in U.S. Pat. No. 3,619,195 and West German Patent No. 1,957,467. Furthermore, a dispersion method in which an emulsion polymerized vinyl polymer is mixed with an emulsified dispersion of high boiling point organic solvent and hydrophobic coupler is disclosed in Japanese Patent Publication No. 39835/76.

Dispersion methods in which a hydrophobic coupler is provided as a hydrophilic colloid layer polymer latex composition (the latex impregnation method) are indicated below.

Polyurethane polymers and polymers obtained by polymerization from vinyl monomers can be used for the aforementioned polymer latex (e.g., methyl acrylate, ethyl acrylate, butyl acrylate, hexyl acrylate, octyl acrylate, decyl acrylate, glycidyl acrylate, etc.), α-substituted acrylic acid esters (e.g., methyl methacrylate, butyl methacrylate, octyl methacrylate, glycidyl methacrylate, etc.), acrylamides (e.g., butylacrylamide, hexylacrylamide, etc.), α-substituted acrylamides (e.g., butylmethacrylamide, dibutylmethacrylamide, etc.), vinyl esters (e.g., vinyl acetate, vinyl butyrate, etc.), vinyl halides (e.g., vinyl chloride, etc.), vinylidene halides (e.g., vinylidene chloride, etc.), vinyl ethers (e.g., vinyl methyl ether, vinyl octyl ether, etc.), styrene, α-substituted styrene (e.g., α-methylstyrene, etc.), ring substituted styrene (e.g., hydroxystyrene, chlorostyrene, methylstyrene, etc.), ethylene, propylene, butylene, butadiene, acrylonitrile, etc. These may be used alone or in combination of two or more and they can also be used in the form of mixtures with other vinyl monomers as minor components. These other vinyl monomers include, for example, itaconic acid, acrylic acid, methacrylic acid, hydroxyalkyl acrylates, hydroxyalkyl methacrylates, sulfoalkyl acrylates, sulfoalkyl methacrylates, styrene sulfonic acid, etc.

The coupler containing polymer latexes can be prepared in accordance with the methods disclosed in Japanese Patent Publication No. 39853/76 and Japanese Patent Application (OPI) Nos. 59943/76, 137131/78, 32552/79, 107941/79, 133465/80, 19043/81, 19047/81, 126830/81, 149038/83, 107642/85 and 140344/85.

A high boiling point organic solvent may or many not be used when dispersion is carried out using this method.

Actual examples of monomers which can be used in the invention and examples of the preferred combinations are indicated below.

1. Butyl acrylate
2. Butyl acrylate-methyl acrylate (mol ratio:5/5)
3. Ethyl acrylate
4. Ethyl acrylate-methyl methacrylate (mol ratio:2/8)
5. Ethyl acrylate-methyl methacrylate (mol ratio:3/7)
6. Ethyl acrylate-methyl methacrylate (mol ratio:4/6)
7. Ethyl acrylate-methyl methacrylate (mol ratio:5/5)
8. Ethyl acrylate-methyl methacrylate (mol ratio:6/4)
9. Ethyl acrylate-methyl methacrylate (mol ratio:7/3)
10. Ethyl acrylate-methyl methacrylate (mol ratio:8/2)
11. Methyl methacrylate
12. Ethyl acrylate-ethyl methacrylate (mol ratio:2/8)
13. Ethyl acrylate-ethyl methacrylate (mol ratio:5/5)
14. Ethyl acrylate-ethyl methacrylate (mol ratio:7/3)
15. Methyl acrylate-acrylic acid (mol ratio:9/1)
16. Butyl acrylate-acrylamide (mol ratio:9/1)
17. Methyl acrylate-vinyl acetate (mol ratio:7/3)
18. Methyl acrylate-ethyl acrylate (mol ratio:6/4)
19. Methyl acrylate-methyl methacrylate-vinyl acetate (mol ratio:4/5/1)
20. Butyl acrylate-methyl methacrylate (mol ratio:2/8)
21. Butyl acrylate-methyl methacrylate (mol ratio:3/7)
22. Butyl acrylate-methyl methacrylate (mol ratio:6/2)
23. Butyl acrylate-methyl methacrylate (mol ratio:8/2)
24. Butyl acrylate-acetoacetoxymethacrylate (mol ratio:8/2)
25. Butyl acrylate-acetoacetoxymethacrylate-acrylic acid (mol ratio:8/1/1)
26. Butyl acrylate-acrylic acid (mol ratio:9/1)
27. Butyl acrylate-3-acryloxybutane-1-sulfonic acid (mol ratio:9/1)
28. 2-Hydroxyethyl methacrylate-butyl acrylate (mol ratio:4/6)

A variety of other organic materials besides the yellow, magenta and cyan couplers, for example, development inhibitor releasing compounds (DIR compounds), colored couplers, ultraviolet absorbers, antifoggants, formalin scavengers, color mixing preventing agents, dyes, matting agents, antistatic agents, development accelerator releasing compounds, developing agent precursors, antioxidants, antifading agents, antistaining agents, etc., can be incorporated into the sensitive material by means of a polymer dispersion of this invention.

General formula (III) is now described in greater detail.

In this formula X' represents a hydrogen atom or a group which can be eliminated by a coupling reaction with the oxidized form of a primary aromatic amine based color developing agent, $R_8$ represents an aryl group (for example, a phenyl group, a naphthyl group, etc.) or a heterocyclic group and $R_9$ represents a ballast group which is required to render the cyan coupler which is represented by the aforementioned general formula (III) and the cyan dye which is formed from the cyan coupler fast to diffusion. $R_8$ preferably represents a naphthyl group or a heterocyclic group (but with a carbon atom of the heterocyclic ring bonded to the ureido group) or a phenyl group which has at least one substituent selected from among a trifluoromethyl group, a nitro group, a cyano group, a halogen atom, $-COR_{12}$, $-COOR_{13}$, $-SO_2OR_{13}$,

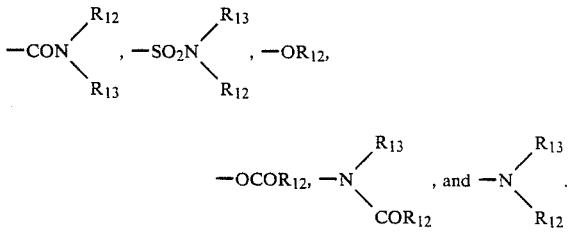

(Here, $R_{12}$ is an aliphatic group or an aromatic group and $R_{13}$ is a hydrogen atom, an aliphatic group or an aromatic group. $R_{12}$ and $R_{13}$ may be joined together to form a ring.)

Actual examples of the preferred cyan couplers of general formula (III) of this invention are shown as general formulae (IIIa) and (IIIb) below.

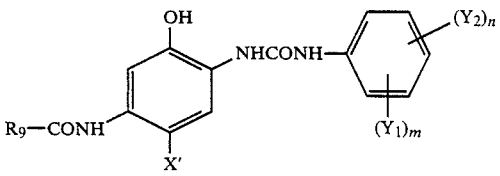

(IIIa)

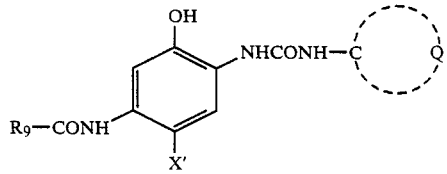

(IIIb)

In these formulae, $Y_1$ is a trifluoromethyl group, a nitro group, a cyano group (but not as a sole para-substituent), a $-COR_{12}$ group, a $-COOR_{13}$ group, an $-SO_2OR_{13}$ group, a

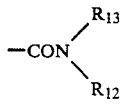

group, an

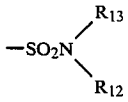

group, an $—OR_{12}$ group, an $—OCOR_{12}$ group, an

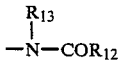

group or an

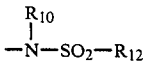

group. $R_{12}$ represents an aliphatic group (preferably an alkyl group with from 1 to 10 carbon atoms, such as a methyl group, a butyl group, a cyclohexyl group, or a benzyl group) or an aromatic group, preferably a phenyl group, for example, a phenyl group or a tolyl group, and $R_{13}$ represents a hydrogen atom or a group represented by $R_{12}$. Furthermore, $R_{12}$ and $R_{13}$ may be joined together to form a ring.

$Y_2$ represents a univalent group and preferably an aliphatic group, preferably an alkyl group which has from 1 to 10 carbon atoms, such as a methyl group, a t-butyl group, an ethoxyethyl group, and a cyanomethyl group, an aromatic group, preferably a phenyl group, such as a phenyl group or a tolyl group, or a naphthyl group, etc., a halogen atom (for example, a fluorine atom, a chlorine atom or a bromine atom), an amino group (for example, an ethylamino group or a diethylamino group), a hydroxyl group or a substituent group as indicated for $Y_1$.

Moreover, m is an integer of value from 1 to 3 and n is an integer of value from 0 to 3.

Q represents a nonmetallic atomic group which is required to form a heterocyclic group or a naphthyl group and the heterocyclic group is preferably a 5-or 6-membered heterocyclic ring which contains from 1 to 4 nitrogen atoms, oxygen atoms or sulfur atoms, being, for example, a furyl group, a thienyl group, a pyridyl group, a quinolyl group, an oxazolyl group, a tetrazolyl group, a benzothiazolyl group, a tetrahydrofuranyl group, etc. These rings may have any substituents, for example, alkyl groups which have from 1 to 10 carbon atoms, halogen atoms, cyano groups, nitro groups, sulfonamido groups, sulfamoyl groups, sulfonyl groups, fluorosulfonyl groups, carbamoyl groups, oxycarbonyl groups, acyl groups, heterocyclic groups, alkoxy groups, aryloxy groups, acyloxy groups, etc.

$R_{12}$ represents an aliphatic group or an aromatic group which is required to render the cyan coupler represented by the aforementioned general formula (III) and the cyan dye which is formed from said coupler, fast to diffusion and is, for example, an alkyl group, an alkenyl group, a cycloakyl group, an aryl group or a 5-or 6-membered heterocyclic group which has from 4 to 30 carbon atoms. It is preferably a group which can be represented by the general formula (IIIc).

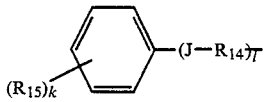

(IIIc)

wherein J is an oxygen atom or a sulfur atom, k is an integer of value 0 to 4 and l is 0 or 1, and when k is 2 or more the two or more $R_{15}$ groups may be the same or different. $R_{14}$ is a linear chain or branched chain alkylene group which has from 1 to 20 carbon atoms and $R_{15}$ is a univalent group, for example, a halogen atom, an alkyl group which has from 1 to 20 carbon atoms, an aryl group, a heterocyclic group, an alkoxy group which has from 1 to 20 carbon atoms, an aryloxy group, a hydroxyl group, an acyloxy group, a carboxyl group, an alkoxycarbonyl group which has from 1 to 20 carbon atoms, an aryloxycarbonyl group, an alkylthio group, an acyl group, an acylamino group, a sulfonamido group, a carbamoyl group, a sulfamoyl group, etc.

X' is a hydrogen atom or a group which can be eliminated during the coupling reaction with the oxidized form of the color developing agent, for example, a halogen atom (e.g., a chlorine atom, a bromine atom or a fluorine atom), an aryloxy group, a carbamoyl group, a carbamoylmethoxy group, an acyloxy group, a sulfonamido group or succinimido group of which the oxygen atom or nitrogen atom is bonded directly to the coupling position, and actual examples have been disclosed in U.S. Pat. No. 3,741,563, Japanese Patent Application (OPI) No. 37425/72, Japanese Patent Publication No. 36894/73 and Japanese Patent Application (OPI) Nos. 10135/75, 1117422/75, 130441/75, 108841/76, 120334/75, 18315/77 and 105226/78.

The cyan couplers of this invention are easily synthesized using the methods disclosed, for example, in U.S. Pat. No. 3,758,308 and Japanese Patent Application (OPI) No. 65134/81, the disclosure of which are incorporated herein by reference.

Specific examples of cyan couplers of this invention which can be represented by general formula (III) are indicated below.

LC-1

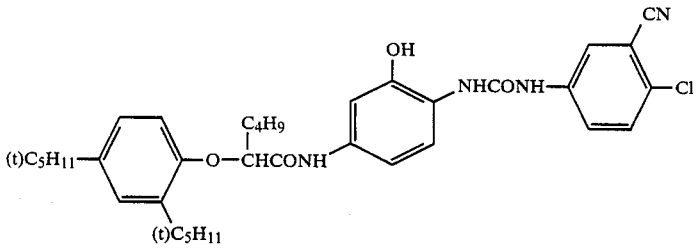

-continued
LC-2
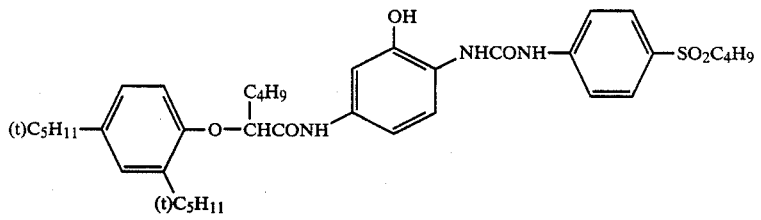
LC-3
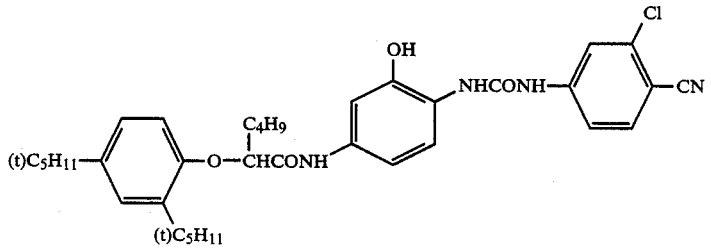
LC-4
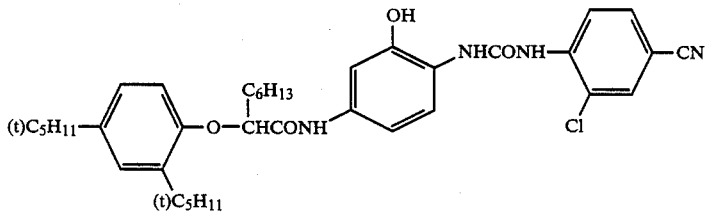
LC-5
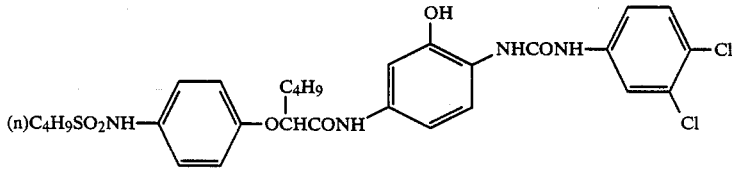
LC-6
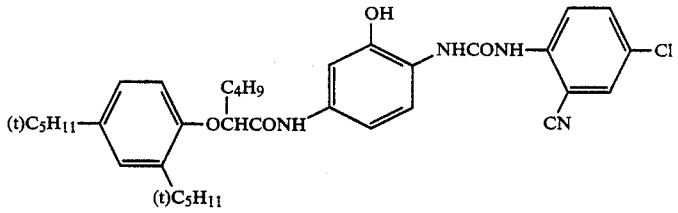
LC-7
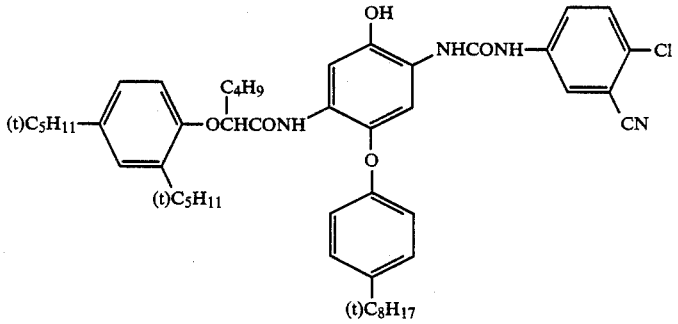

-continued

LC-8

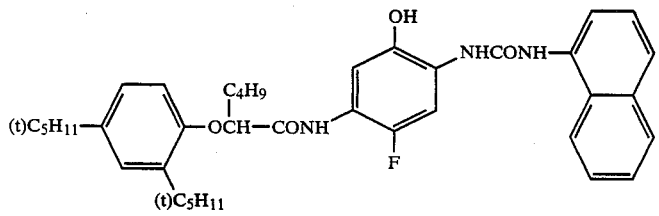

LC-9

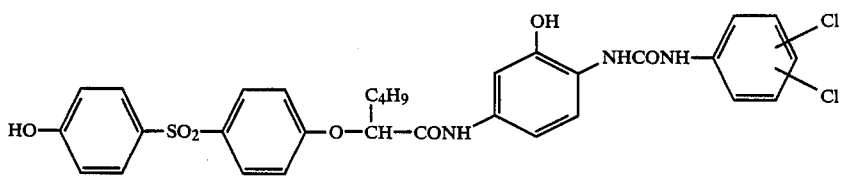

LC-10

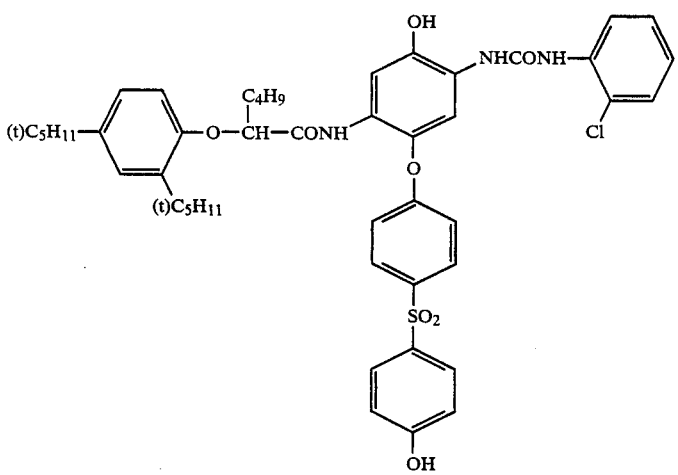

The preferred couplers, silver halides and layer structures for use in the invention are described below.

Sensitive materials of reduced layer thickness in which development inhibitor releasing couplers (DIR couplers) are used and the amounts of silver and gelatin are also reduced are generally such that the development inhibitor is liable to flow out from said sensitive material into the developer and so methods in which a fine grained silver halide is included in the layer close to the surface of the sensitive material and with which developer contamination is prevented are preferably used.

Methods in which non-light-sensitive intermediate layers are established in the groups of layers of the same color sensitivity are known for improving granularity and color reproduction properties but this has the disadvantage of increasing the film thickness. In the sensitive materials of this invention the deterioration in sharpness due to the increase in film thickness is suppressed and thus such a multilayer construction is preferably used.

Layer structures which have non-light-sensitive layers in which compounds which can react with the oxidized form of the primary aromatic developing agent can be included between a plurality of light-sensitive silver halide emulsion layers of the same color sensitivity on the silver halide color sensitive material supports which are preferably used in the invention are described below.

One embodiment of said layer structure is described below. The plurality of light-sensitive silver halide emulsion layers which have different speeds with essentially the same color sensitivity which are established on the support of a silver halide color-sensitive material consist, for example, of a high speed emulsion layer and a low speed emulsion layer when there are two layers or a high speed emulsion layer, an intermediate speed emulsion layer and a low speed emulsion layer when there are three layers. In this invention the high speed emulsion layer is preferably established further away from the support than the low speed emulsion layer. Moreover, the non-light-sensitive intermediate layers which are preferably used in the invention are preferably established adjacent to said high speed emulsion layers on the side closest to the support. The high speed emulsion and low speed emulsion layers between which said intermediate layer is sandwiched may be single layers but if there are two or more layers the effect of the method disclosed in British Patent No. 923,045 is also realized and this is preferred.

In cases where the light-sensitive silver halide emulsion layers which have essentially the same color sensitivity consist of a high speed emulsion layer, an intermediate speed emulsion layer and a low speed emulsion layer then in one preferred embodiment the construction satisfies the four requirements (i) to (iv) below.

(i) The layers are coated onto the support in the order low speed emulsion layer, intermediate speed emulsion layer, high speed emulsion layer.

(ii) The non-light-sensitive intermediate layer is coated between the low speed emulsion layer and the intermediate speed emulsion layer.

(iii) The density of the dye image forming coupler in the above-mentioned intermediate speed emulsion layer (the amount of dye image forming coupler contained in said layer with respect to the hydrophilic colloid binder of said layer) is 10 to 60% of the dye image forming coupler density in the above-mentioned low speed emulsion layer.

(iv) The maximum color density (D) in the above-mentioned intermediate speed emulsion layer is $0.6 < D < 1.2$.

In cases where the non-light-sensitive intermediate layer is sandwiched between emulsion layers of two different speeds, i.e., a high speed layer and a low speed layer, a compound which is able to undergo a coupling reaction with the oxidized form of a primary aromatic amine based developing agent is preferably included in the intermediate layer.

The compound which can undergo a coupling reaction with the oxidized form of a primary aromatic amine based developing agent may be a dye image forming coupler, a coupler which releases a development inhibitor or a precursor thereof (a DIR coupler), a coupler which releases a compound which captures the oxidized form of the developing agent, a compound which can form coupling products of a type which are able to flow out, etc.

The preferred compounds are DIR couplers, compounds which can form coupling products which are able to flow out and couplers which are fast to diffusion which can form mobile colored dyes.

The compounds disclosed in Japanese patent application (OPI) Nos. 80255/86, 42656/86, 20037/86, 20038/86, 113440/84 and 113438/84 can be used as the above mentioned compounds.

Various types of photographic materials such as diffusion inhibitors, couplers, hydroquinone derivatives for controlling the progress of development, colorless couplers, and fine grain silver halide emulsions can also be included in the intermediate layers which are preferably used in the invention as well as the compounds of this invention.

Non-light-sensitive hydrophilic colloid layers which contain fine silver halide grains which are preferably used in the invention are described below.

The red-sensitive layer group, the green-sensitive layer group and the blue-sensitive layer group are coated in this order from the support side on the support of a silver halide color-sensitive material. The aforementioned blue-sensitive layer group consists of a plurality of silver halide emulsion layers which have different speeds and these are coated in order of increasing speed from the support side. A non-light-sensitive hydrophilic colloid layer consisting of at least one layer is established adjacent to the blue-sensitive color emulsion layer of the highest speed which is furthest away from the above-mentioned support and fine silver halide grains are included in at least one of said non-light-sensitive hydrophilic colloid layers.

In a more preferred embodiment, the non-light-sensitive hydrophilic emulsion layer is established on the opposite side to the support of the blue-sensitive layer of the highest speed which is furthest away from the aforementioned support and a photographic coupler which forms a colored dye which has essentially the same hue as the photographic coupler which is included in the adjacent blue-sensitive layer is included in said non-light-sensitive hydrophilic colloid layer.

The fine silver halide grains in this embodiment are silver halide grains which are not sensitive to light during the image exposure for forming the dye image and which remain essentially undeveloped in the developer, being silver halide grains which have not been prefogged.

The fine silver halide grains may have a silver bromide content of 0 to 100 mol % and the silver halide can have various compositions provided that it contains silver bromide in these proportions.

Thus, the fine silver halide grains may contain silver chloride and/or silver iodide as required. The grains have an average grain size of 0.01 to 0.3 μm and a preferred grain size of 0.02 to 0.2 μm. The average grain size of silver halide grains of this type signifies the average value of the diameters of the circles corresponding to the projected areas of the individual silver halide grains and it can be measured, for example, using the method described on pages 227 and 228 of *Fundamental of Photographic Engineering—Silver Salt Photography Ed.* (published by the Japanese Photographic Society, Jan. 30, 1979).

The amount of fine silver halide grains added to the non-light-sensitive hydrophilic colloid layer of a light-sensitive material of this invention depends on a number of factors, such as the halogen composition of the fine grained silver halide, the grain size, the bromide ion concentration of the developer and the light-sensitive emulsion layer, especially the amount and composition of the silver halide grains which are contained in the blue-sensitive emulsion layer, but in general they are included at a rate of 0.1 to 50 mg/dm$^2$ and preferably at a rate of 1 to 10 mg/dm$^2$.

The silver halide emulsions used to improve the sharpness by reducing the layer thickness in this invention are preferably monodispersed emulsions.

The monodispersed emulsions preferably used in the invention are emulsions which have a grain size distribution such that the variation coefficient $s/\bar{r}$ for the silver halide grain diameters is not greater than 0.25. Here, $\bar{r}$ is the average grain diameter and S is the standard deviation of the grain diameter. Thus, if the grain diameter of an individual grain is $r_i$ and the number of individual grains is $n_i$, then the average grain diameter $\bar{r}$ is defined by the following equation:

$$\bar{r} = \frac{\Sigma n_i \cdot r_i}{\Sigma n_i}$$

Moreover, the standard deviation S is defined by the following equation:

$$S = \sqrt{\frac{\Sigma(\bar{r} - r_i)^2 \cdot n_i}{\Sigma n_i}}$$

The diameter of an individual grain in this invention is the diameter of a corresponding projected area corresponding to the projected area when a photograph is taken using the methods well known in the industry (normally involving electron microscopy photographs) such as that disclosed on pages 36 to 43 of *The Theory of the Photographic Process* by T. H. James et al., third Edition, published by Macmillan (1966). Here, the diameter of a corresponding area of a silver halide grain is defined as the diameter of the circle which is equal in area to the projected area of the silver halide grain as indicated in the book referred to above. Thus, the average grain diameter $\bar{r}$ and the standard deviation S can be obtained in the way described above even in cases where the form of the silver halide grains is other than spherical (for example, in the case of grains which have a cubic, octahedral, tetradecahedral, tabular or potato-like form, etc.).

The coefficient of variation for the grain diameter of the silver halide grains is not more than 0.25, preferably not more than 0.20 and most desirably not more than 0.15.

No particular limitation is imposed upon the size of the silver halide grains but the preferred size is 0.4 to 5 μm and a grain size of 0.6 to 3 μm, especially of 0.8 to 2.5 μm, is most desirable.

The silver halide grains may have a regular crystalline form such as a hexahedral form, octahedral form, dodecahedral form, tetradecahedral form (a regular crystalline form) or they may have a spherical form or an irregular crystalline form such as a potato-like form or a tabular form.

In the case of regular crystal grains those which have at least 50% (111) plane are especially desirable. Moreover, grains which have at least 50% (111) plane are also especially desirable in the case of irregular crystal forms. The area fraction of the (111) plane can be assessed using the "Kubelka·Monk" dye adsorption method. In this method a dye which is adsorbed preferentially on the (111) plane or the (100) plane and with which the state of the dye bound to the (111) plane and the state of the dye bound to the (100) plane have different spectra is selected. Thus, the dye is added to the emulsion and the area ratio of the (111) plane can be determined by investigating in detail the optical spectra with respect to the amount of dye which has been added. For details of the above-mentioned dye adsorption method see the paper by T. Tani on page 942 et seq. of Nippon Kagaku Shi (1984).

The halogen composition of the light-sensitive silver halide grains includes at least 60 mol % of silver bromide and preferably not more than 10 mol % of silver chloride. The preferred composition contains 2 to 40 mol % and most desirably 5 to 20 mol % of silver iodide. The halogen distribution between grains is preferably uniform.

The most desirable halogen composition for the monodispersed emulsions used in the invention is found in grains which have a distinct layer structure consisting essentially of two layers in the form of a core part which has a high iodine content and a shell part which has a low iodine content. The layer structure of these grains is described below.

Thus, the core part preferably consists of a silver halide which has a high iodine content which may be between 10 mol % and 45 mol %, the solid solution limit.

Thus, the preferred iodine content of the core part of the silver iodide grains is 10 to 45 mol % and the most desirable iodine content is 15 to 40 mol %.

The silver halide other than silver iodide in the core part may be silver chloride or silver bromide but a higher proportion of silver bromide is preferred.

The outermost layer consists of silver halide which contains not more than 5 mol % of silver iodide and preferably of silver halide which contains not more than 2 mol % of silver iodide.

The silver halide other than silver iodide in the outermost layer may be silver chloride, silver chlorobromide or silver bromide but a high proportion of silver bromide is preferred.

The distinct layer structure described can be assessed using the X-ray diffraction method. An example of the application of this method to silver halide grains has been described on page 129 et sec. of the *Journal of Photographic Science*, Volume 10 (1962) in a paper by H. Hirsch. The lattice constant is determined by the halogen composition and a diffraction peak is produced at the diffraction angle which satisfies the Bragg condition ($2d \sin\theta = n\lambda$).

The X-ray diffraction method of measurement is described in detail in No. 24 of *The Fundamental Analytical Chemistry Series* entitled "X-Ray Diffraction" (published by Kyoritsu Shuppan, 1968) and in *Introduction to X-Ray Diffraction* (published by the Rigaku Denki Co., Ltd.). Copper is used for the target in the standard measuring procedure and the diffraction curve of the (220) plane of the silver halide is obtained using the Cu $K_\beta$ line as a source line (tube voltage 40 kV, tube current 60 mA). The slit widths (width of the exit slit and the receiving slit, etc.), the time constant of the apparatus, the goniometer scanning rate and the recording speed are selected to as to maximize the resolution of the measuring apparatus and the accuracy of the measurements must be verified using a standard sample such as silicon.

If the emulsion grains have a distinct two layer structure then two peaks will be produced on the diffraction curve due to the diffraction maxima of the silver halide in the layer which has a high iodine content and the diffraction maxima due to the silver halide in the layer which has a low iodine content.

With an essentially distinct two layer structure the two maxima for the diffraction peak corresponding to the layer which has a high iodine content, containing 10 to 45 mol % of silver iodide, and the diffraction peak corresponding to the layer which has a low iodine content, containing not more than 5 mol % of silver iodide, have a single minimum between them and moreover the diffraction intensity corresponding to the layer which has a high iodine content has a ratio of from 1/1 to 3/1 with the diffraction intensity of the peak corresponding to the layer which has a low iodine content when the diffraction intensity vs diffraction angle curve for the (220) plane of the silver halide is obtained using the Cu $K_\beta$ line in the diffraction angle ($2\theta$) range from 38° to 42°. The preferred value for this diffraction intensity ratio is from 1/5 to 3/1 and a diffraction intensity ratio of from 1/3 to 3/1 is especially desirable.

The diffraction intensity of the minimum value between the two peaks for an emulsion which has an essentially distinct two layer structure is preferably 90% or less of that of the diffraction maximum (peak) which is the weaker of the two diffraction maxima.

A value of 80% or less is more desirable and most desirably the value is 60% or less. Methods for analyzing diffraction curves in which two diffraction components are present are well known and are described, for example, in No. 11 of the *Experimental Physics Series*, entitled "Lattice Defects" (published by Kyoritsu Shuppan, 1978).

If the curve is assumed to be a function such as a Gauss function or a Lorentz function it can be analyzed using a curve analyzer made by the Du Pont Co., for example.

Two peaks also appear in the diffraction curves obtained in the case of an emulsion which contains two types of grains which have different halogen compositions but which do not have a distinct layer structure.

It is possible to ascertain whether a silver halide emulsion contains grains which have a layered structure or whether it contains two types of silver halide grains as mentioned above by using the EPMA method (electron probe microanalyzer method) in addition to the X-ray diffraction method.

With this method a well dispersed sample in which the emulsion grains are not touching each other is prepared and irradiated with an electron beam. Elemental analysis of very small parts can be achieved by means of X-ray diffraction caused by the electron beam excitation.

The halogen compositions of individual grains can be determined by obtaining the characteristic X-ray intensities for silver and iodine which are radiated from each grain using this method.

If the halogen composition of at least 50 individual grains is verified using the EPMA method, it is possible to assess whether or not the emulsion contains grains which have a layered structure.

Emulsions in which the grains have a layered structure and in which the iodine content is uniform between the grains are preferred.

When the distribution of the iodine content between grains is measured using the EPMA method, the standard deviation should be 50% or less, preferably 35% or less and most desirably 20% or less.

The silver halide with a high iodine content in the core must be satisfactorily covered with a silver halide shell which has a low iodine content to obtain the photographic properties preferred for an emulsion consisting of silver halide grains which have a distinct layered structure. The shell layer required differs according to the grain size but with large grains of 1.0 μm or more a shell thickness of 0.1 μm or more is desirable while with small grains smaller than 1.0 μm a shell thickness of at least 0.05 μm is desirable. The silver ratio of the shell part with respect to the core part for obtaining an emulsion which has a distinct layered structure is preferably within the range 1/5 to 5 and it is preferably within the range 1/5 to 3 and most desirably within the range 1/5 to 2.

If the silver halide grains have a structure consisting of two essentially distinct layers then the two regions of different compositions within the grain can be described as a core part in the case of the middle part within the grain and a shell part in the case of the surface part of the grain.

The meaning of the expression "two essentially distinct layers" also encompasses cases in which a third region is present as well as the core and shell parts, for example, where there is a layer present between the central core part and the outermost shell part.

However, when such a third region is present it should be present in such a range that it has essentially no effect on the form of the two peaks (which is to say the two peaks corresponding to the part which has a high iodine content and the part which has a low iodine content) when an X-ray diffraction pattern is obtained in the way described above.

A third region may similarly be present within the core part.

The use of tabular silver halide emulsions is preferred in this invention since there is less light scattering from the surfaces of the grains in such an emulsion and so light scattering is suppressed and this improves sharpness.

Tabular silver halide emulsions in which at least 50% of all the projected area of the silver halide grains consists of tabular silver halide grains which have an average aspect ratio of 5/1 or more are preferred.

The average aspect ratio of the tabular silver halide emulsions which are preferably used in this invention is the average value of the ratio of the diameter relative to the thickness of the silver halide grains. Here, the diameter is the diameter of a circle which has the same area as the projected area of the grain when observed using a microscope or an electron microscope. Hence, an average aspect ratio of at least 5/1 means that the diameter of this circle is at least five times greater than the thickness of the grain.

The grain diameter is at least five times the grain thickness in the case of the tabular silver halide grains which are used in the silver halide emulsions of this invention but it is preferably 5 to 100 times greater than the grain thickness, more desirably 5 to 50 times the grain thickness and most desirably 5 to 20 times the grain thickness. Furthermore, the proportion of the projected area of all of the silver halide grains accounted for by tabular silver halide grains is at least 50%, preferably at least 70%, and most desirably at least 85%.

It is possible to obtain silver halide photographic materials which have excellent sharpness using emulsions of this type. The excellent sharpness arises because there is much less light scattering when such emulsions are used when compared to that of a conventional emulsion. This can be verified easily using the test methods normally used in the industry. The reason for the small amount of light scattering by tabular silver halide emulsions are unclear but it is thought that the fact that the tabular silver halide emulsions are orientated parallel to the support may be of importance.

Furthermore, the diameter of the tabular silver halide grains is 0.2 to 20 μm, preferably 0.3 to 10.0 μm and most desirably 0.4 to 3.0 μm. The preferred grain thickness is 0.3 μm or less. Here, the diameter of the tabular silver halide grains is the diameter of a circle which has the same area as the projected area of the grain. Furthermore, the thickness of the grain is given as the distance between the two parallel surfaces of the tabular silver halide grain structure.

In this invention the preferred tabular silver halide grains have a grain diameter of at least 0.3 μm but not more than 10.0 μm and a grain thickness of not more than 0.3 μm and moreover they have an average grain diameter/average grain thickness ratio of at least 5 but not more than 50. The most desirable silver halide photographic emulsions are those in which grains which have a grain diameter of at least 0.4 μm but less than 5.0 μm and an average diameter/average thickness ratio of at least 5 account for at least 85% of all of the silver halide grains.

The tabular silver halide and other silver halides used in this invention may be silver chloride, silver bromide, silver chlorobromide, silver iodobromide, silver chloroiodobromide but silver bromide, silver iodobromides which contain not more than 15 mol % of silver iodide or silver chloroiodobromides. Silver chlorobromides which contain less than 50 mol % of silver chloride and less than 2 mol % of silver iodide are preferred. The composition distribution in the mixed silver halides may be uniform or localized.

The grain size of the silver halide may be fine with a grain diameter of about 0.2 μm or less or large with a projected area diameter up to about 10 μm and it may take the form of a polydispersed emulsion or a monodispersed emulsion.

The silver halide photographic emulsions which can be used in the invention can be prepared using the methods disclosed, for example, in *Research Disclosure*, (RD) No. 17644 (Dec., 1978), pages 22 and 23, "I, Emulsion Preparation and Types", and in RD No. 18716 (Nov., 1979), page 648; in *Chemie et Physique Photographique* by P. Glafkides, published by Paul Montel, 1967; in *Photographic Emulsion Chemistry* by G. F. Duffin, published by Focal Press, 1966; in *Making and Coating Photographic Emulsions* by V. L. Zelikman et al., published by Focal Press, 1964, etc.

The monodispersed emulsions such as disclosed in U.S. Pat. Nos. 3,574,628 and 3,655,394 and British Pat. No. 1,413,748, etc., are preferred.

Furthermore, tabular grains which have an aspect ratio of at least about 5 can be used in this invention. Tabular grains can be prepared easily using methods such as those disclosed by Gutoff in *Photographic Science and Engineering*, Vol. 14, pp. 248 to 257 (1970), and in U.S. Pat. Nos. 4,434,226, 4,414,310, 4,433,048 and 4,439,520 and in British Pat. No. 2,112,157, etc.

The crystal structure may be uniform, the interior and exterior parts may have a heterogeneous halogen composition or the grains may have a layered structure and moreover silver halides which have different compositions may be joined with an epitaxial junction or they may be joined to compounds other than silver halides such as silver thiocyanate or lead oxide, etc.

Mixtures of grains of various crystalline forms may also be used.

The silver halide emulsions used are normally subjected to physical ripening, chemical ripening and spectral sensitization. The additives used in these processes are disclosed in *Research Disclosure*, RD Nos. 17643 and 18716 and the locations of these items are summarized in the table below.

Known photographic additives which can be used in this invention are also disclosed in the two *Research Disclosures* mentioned above and the locations of these disclosures are also shown in the table below.

| Type of Additive | RD 17643 | RD 18716 |
|---|---|---|
| 1. Chemical sensitizers | Page 23 | Page 648, right col. |
| 2. Speed increasing agents | | As above |
| 3. spectral sensitizers and supersensitizers | Pages 23–24 | Pages 648, right col. to 649, right col. |
| 4. Whiteners | Page 24 | |
| 5. Antifoggants and stabilizers | Pages 24–25 | Page 649, right col. |
| 6. Light absorbers, filter dyes, UV absorbers | Pages 25–26 | Pages 649, right col. to 650, left col. |
| 7. Antistaining agents | Page 25, right col. | Page 650, left to right col. |
| 8. Dye image stabilizers | Page 25 | |
| 9. Film hardening agents | Page 26 | Page 651, left col. |
| 10. Binders | Page 26 | As above |
| 11. Plasticizers, lubricants | Page 27 | Page 650, right col. |
| 12. Coating assistants, surfactants | Pages 26–27 | As above |
| 13. Antistatic agents | Page 27 | As above |

Various color couplers can be used in this invention and examples of these are disclosed in the patents disclosed in *Research Disclosure*, (RD) No. 17643, VII-C to G.

Those disclosed in U.S. Pat. Nos. 3,933,501, 3,973,968, 4,022,620, 4,326,024 and 4,401,752, Japanese Patent Publication No. 10739/83 and British Pat. Nos. 1,425,020, 1,476,760, etc., are the preferred yellow couplers.

The 5-pyrazolone based and pyrazoloazole based compounds are preferred for the magenta couplers and those disclosed in U.S. Pat. Nos. 4,310,619 and 4,351,897, European Pat. No. 73,636, U.S. Pat. Nos. 3,061,432 and 3,725,067, *Research Disclosure*, RD No. 24220 (Jun., 1984), Japanese patent application (OPI) No. 33552/85, *Research Disclosure*, RD No. 24230 (Jun., 1984), Japanese patent application (OPI) No. 43659/85 and U.S. Pat. Nos. 4,500,630 and 4,540,654, etc., are most desirable. These couplers, unless adversely affecting the effects of the present invention, may be used in combination with the couplers of the present invention.

Phenol based and naphthol based couplers are preferably used for the cyan couplers and those disclosed in U.S. Pat. Nos. 4,052,212, 4,146,396, 4,228,233, 4,296,199, 4,296,200, 2,369,929, 2,801,171, 2,772,162, 2,895,826, 3,772,002, 3,758,308, 4,334,011 and 4,327,173, West German Pat. No. (OLS) 3,329,729, European Pat. No. 121,365A, U.S. Pat. Nos. 3,446,622, 4,333,999, 4,451,559 and 4,427,767 and European Pat. No. 161,626A are most preferred.

The colored couplers for correcting the unwanted absorptions of the colored dyes disclosed in *Research Disclosure*, RD No. 17643, Section VII-G, U.S. Pat. No. 4,163,670, Japanese Patent Publication No. 39413/82, U.S. Pat. Nos. 4,004,929 and 4,138,258 and British Pat. No. 1,146,368 are preferred.

The couplers of which the colored dyes have a suitable degree of diffusibility disclosed in U.S. Pat. No. 44,366,237, British Pat. No. 2,125,570, European Pat. No. 96,570 and West German Pat. No. (OLS) 3,234,533 are preferred.

Typical examples of polymerized dye forming couplers are disclosed in U.S. Pat. Nos. 3,451,820, 4,080,211 and 4,367,282 and British Pat. No. 2,102,173.

Couplers which release residual groups which are useful photographically on coupling can also be used preferentially in this invention. The DIR couplers which release development inhibitors disclosed in the patent disclosed in the aforementioned *Research Disclosure*, RD No. 17643, Section VII-F, Japanese patent application (OPI) Nos. 151944/82, 154234/82 and 184248/85 and U.S. Pat. No. 4,248,962 are preferred.

The couplers which release nucleating agents or development accelerators in the form of the image during development disclosed in British Patents 2,097,140 and 2,131,188 and Japanese Patent Application (OPI) Nos. 157638/84 and 170840/84 are preferred.

Other couplers which can be used in the light-sensitive materials of this invention include the competitive couplers as disclosed in U.S. Pat. No. 4,130,427, etc., the poly-equivalent couplers as disclosed in U.S. Pat. Nos. 4,283,472, 4,338,393 and 4,310,618, etc., the DIR redox compound releasing couplers as disclosed in Japanese Patent Application (OPI) No. 185950/85, etc., and the couplers which release a dye which restores coloration after elimination as disclosed in European Patent No. 173,302A.

Couplers disclosed in U.S. Pat. No. 4,543,323 and Japanese Patent Application (OPI) No. 20037/86 which will flow out of the photographic light-sensitive material because the couplers are allowed to react with the oxidation products of the developing agents to produce the coupling products having alkali-soluble groups may be used in the emulsion layers or the non-light-sensitive intermediate layers.

DIR compounds disclosed in Japanese Patent Application (OPI) Nos. 149360/84 and 149361/84 which will flow out of the photographic light-sensitive materials because the DIR compounds are allowed to react with the oxidation products of the developing agents to release development inhibitors or their precursors and to thereby produce coupling products having alkali-soluble groups may be used.

The couplers which are used in the invention can be introduced into the light-sensitive materials using the various known methods of dispersion.

Examples of high boiling point solvents which can be used in the oil-in-water dispersion methods are disclosed in U.S. Pat. No. 2,322,027, etc.

Examples of processes and effects of the latex dispersion method and of latexes for impregnation purposes are disclosed in U.S. Pat. No. 4,199,363 and West German Patent Nos. (OLS) 2,541,274 and 2,541,230, etc.

Suitable supports which can be used in this invention are disclosed on page 28 of the aforementioned *Research Disclosure*, No. 17643 and in the section from the right hand column of page 647 to the left hand column of page 648 of *Research Disclosure*, No. 18716.

The color photographic light-sensitive materials of this invention are normally subjected to a washing or stabilizing process after development, bleach-fixing or fixing processes.

The washing process is generally carried out with a counter-flow in two or more tanks to economize on water usage. A typical example of a stabilization process which can be used in place of the washing process is seen in the multistage counter flow stabilization processes like that disclosed in Japanese Patent Application (OPI) No. 8543/82.

The invention will now be described in practical terms by means of examples but the invention is not limited by these examples. Unless otherwise specified, all units, parts and percentages are in terms of weight.

EXAMPLE 1

Samples 101 to 108 were prepared by establishing the layers indicated below in order from the support on a support consisting of an undercoated cellulose triacetate film.

In the following example, the silver halide emulsions and colloidal silver are indicated as grams per square meter (g/m$^2$) calculated as silver. Furthermore, the materials used are indicated as coated weights (g/m$^2$).

PREPARATION OF SAMPLE 101

| First Layer: Antihalation Layer | |
|---|---|
| Black colloidal silver | 0.2 |
| Gelatin | 2.0 |
| Ultraviolet Absorber UV-1 | 0.2 |
| High Boiling Point Organic Solvent OIL-1 | 0.02 |
| Film Thickness 1.75 μm | |
| **Second Layer: Intermediate Layer** | |
| Gelatin | 1.3 |
| Film Thickness 1.00 μm | |
| **Third Layer: First Red-Sensitive Emulsion Layer** | |
| Monodispersed silver iodobromide emulsion (5 mol % silver iodide, average grain size 0.3 μm) | 1.5 |
| Gelatin | 3.0 |
| Sensitizing Dye A | $1.0 \times 10^{-4}$ |
| Sensitizing Dye B | $2.0 \times 10^{-4}$ |
| Sensitizing Dye C | $1.0 \times 10^{-4}$ |
| Coupler C-2 | 0.6 |
| Coupler C-3 | 0.2 |
| Coupler C-4 | 0.02 |
| Coupler C-5 | 0.01 |
| High Boiling Point Organic Solvent OIL-1 | 0.1 |
| High Boiling Point Organic Solvent OIL-2 | 0.1 |
| Film Thickness 3.25 μm | |
| **Fourth Layer: Second Red-Sensitive Emulsion Layer** | |
| Monodispersed silver iodobromide emulsion (4 mol % silver iodide, average grain size 0.7 μm) | 1.2 |
| Gelatin | 2.5 |
| Sensitizing Dye A | $3 \times 10^{-4}$ |
| Sensitizing Dye B | $2 \times 10^{-4}$ |
| Sensitizing Dye C | $1 \times 10^{-4}$ |
| Coupler C-1 | 0.02 |
| Coupler C-3 | 0.03 |
| Coupler C-6 | 0.05 |
| Coupler C-5 | 0.02 |
| High Boiling Point Organic Solvent OIL-2 | 0.1 |
| Film thickness 2.10 μm | |
| **Fifth Layer: Intermediate Layer** | |
| Gelatin | 1.5 |
| Compound Cpd-A | 0.05 |
| High Boiling Organic Solvent OIL-2 | 0.05 |
| Film Thickness 1.20 μm | |
| **Sixth Layer: First Green-Sensitive Emulsion Layer** | |
| Monodispersed silver iodobromide emulsion (3 mol % silver iodide, average grain size 0.3 μm) | 0.4 |
| Monodispersed silver iodobromide emulsion (6 mol % silver iodide, average grain size 0.5 μm) | 0.8 |
| Gelatin | 3.0 |
| Sensitizing Dye D | $3 \times 10^{-4}$ |
| Sensitizing Dye E | $2 \times 10^{-4}$ |
| Sensitizing Dye F | $1 \times 10^{-4}$ |
| Coupler C-7 | 0.4 |
| Coupler C-8 | 0.1 |
| Coupler C-9 | 0.02 |
| Coupler C-10 | 0.01 |
| High Boiling Point Organic Solvent OIL-2 | 0.05 |
| Film Thickness 2.80 μm | |
| **Seventh Layer: Second Green-Sensitive Layer** | |
| Monodispersed silver iodobromide emulsion (4 mol % silver iodide, average grain size 0.8 μm) | 0.9 |
| Gelatin | 1.5 |
| Sensitizing Dye D | $2 \times 10^{-4}$ |
| Sensitizing Dye E | $1.5 \times 10^{-4}$ |
| Sensitizing Dye F | $1 \times 10^{-4}$ |
| Coupler C-9 | 0.08 |
| Coupler C-7 | 0.04 |
| Coupler C-8 | 0.02 |
| Coupler C-10 | 0.01 |
| High Boiling Point Organic Solvent OIL-1 | 0.08 |
| High Boiling Point Organic Solvent OIL-3 | 0.03 |
| Film Thickness 1.40 μm | |
| **Eighth Layer: Intermediate Layer** | |

-continued

| | |
|---|---|
| Gelatin | 1.5 |
| Compound Cpd-A | 0.6 |
| High Boiling Point Organic Solvent OIL-1 | 0.3 |
| | Film Thickness 2.00 μm |
| Ninth Layer: Yellow Filter Layer | |
| Yellow colloidal silver | 0.05 |
| Gelatin | 1.5 |
| Compound Cpd-A | 0.2 |
| High Boiling Point Organic Solvent OIL-1 | 0.1 |
| | Film Thickness 1.45 μm |
| Tenth Layer: First Blue-Sensitive Emulsion Layer | |
| Monodispersed silver iodobromide emulsion (7 mol % silver iodide, average grain size 0.3 μm) | 0.4 |
| Monodispersed silver iodobromide emulsion (6 mol % silver iodide, average grain size 0.6 μm) | 0.4 |
| Gelatin | 2.0 |
| Sensitizing Dye E | $2 \times 10^{-4}$ |
| Coupler C-11 | 0.9 |
| Coupler C-5 | 0.05 |
| High Boiling Point Organic Solvent OIL-3 | 0.30 |
| | Film Thickness 2.45 μm |
| Eleventh Layer: Second Blue-Sensitive Emulsion Layer | |
| Monodispersed silver iodobromide emulsion (7 mol % silver iodide, average grain size 1.5 μm) | 0.8 |
| Gelatin | 1.5 |
| Sensitizing Dye E | $1 \times 10^{-4}$ |
| Coupler C-11 | 0.2 |
| Coupler C-5 | 0.05 |

-continued

| | |
|---|---|
| High Boiling Point Organic Solvent OIL-3 | 0.07 |
| | Film Thickness 1.60 μm |
| Twelfth Layer: First Protective Layer | |
| Fine grain silver bromide emulsion (4 mol % silver iodide, average grain size 0.07 μm) | 0.3 |
| Gelatin | 1.0 |
| Ultraviolet Absorber UV-2 | 0.1 |
| Ultraviolet Absorber UV-3 | 0.2 |
| High Boiling Point Organic Solvent OIL-3 | 0.01 |
| | Film Thickness 1.25 μm |
| Thirteenth Layer: Second Protective Layer | |
| Gelatin | 1.0 |
| Poly(methyl methacrylate) grains (1.5 μm diameter) | 0.2 |
| Formaldehyde Scavenger S-1 | 0.5 |
| | Film Thickness 1.50 μm |

Surfactant W-1 and Film Hardener H-1 were also added.

The sample coated with the layer structure indicated above was Sample 101.

The dry film thickness from the surface closest to the support of the light-sensitive layer closest to the support to the surface of the side furthest from the support of the protective layer furthest from the support enclosing the light-sensitive layer as specified in this invention was 21 μm in the above-mentioned sample.

The structural formulae of the materials used in this example are indicated below.

Sensitizing Dye A:

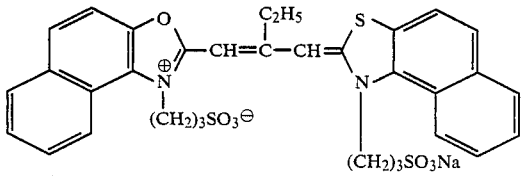

Sensitizing Dye B:

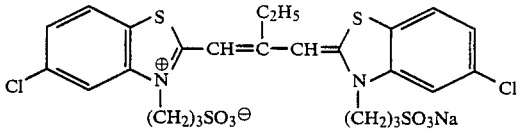

Sensitizing Dye C:

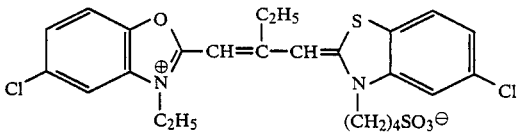

Sensitizing Dye D:

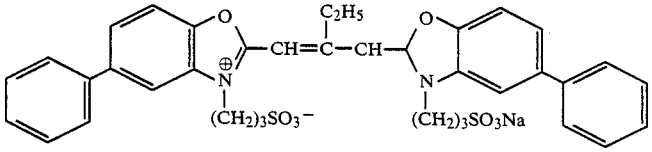

Sensitizing Dye E:

-continued
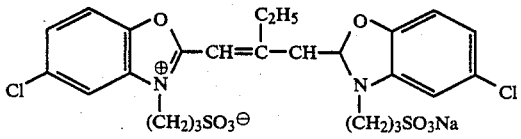
Sensitizing Dye F:
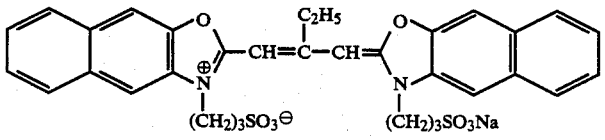
Sensitizing Dye G:
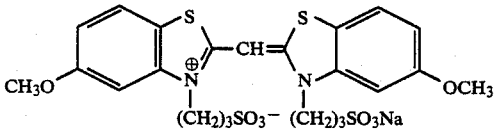
Coupler C-1:
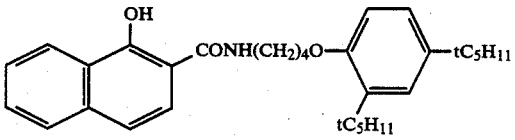
Coupler C-2 (Illustrative Coupler LC-2):
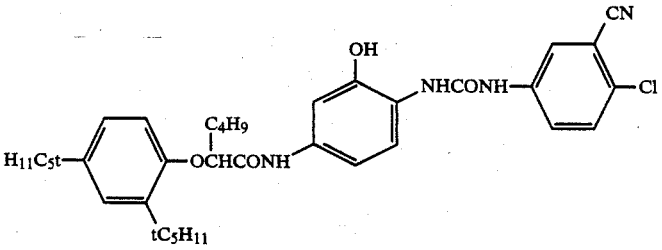
Coupler C-3:
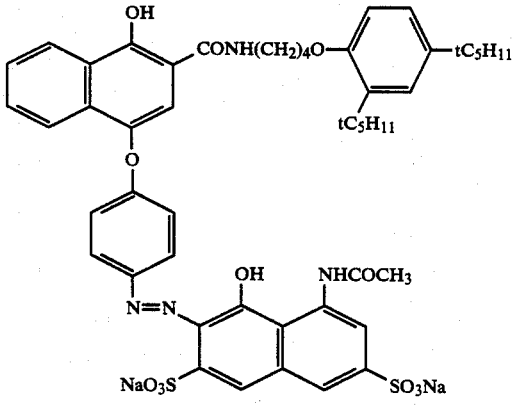
Coupler C-4:

-continued
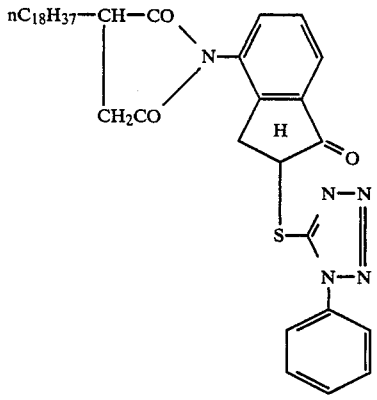
Coupler C-6:
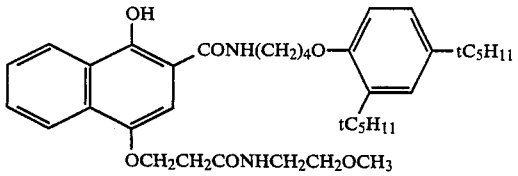
Coupler C-7:
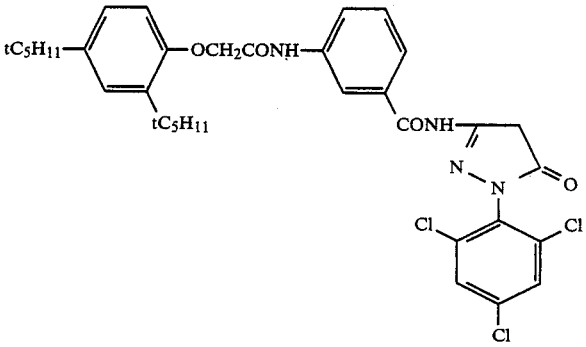
Coupler C-8:
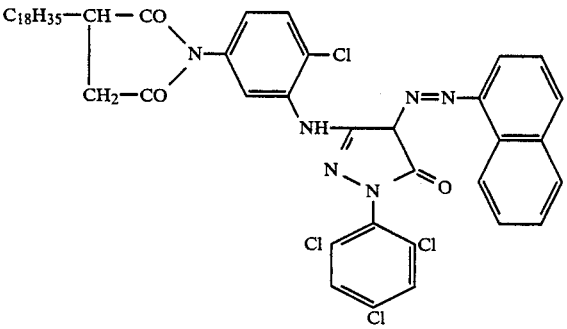
Coupler C-5:

-continued
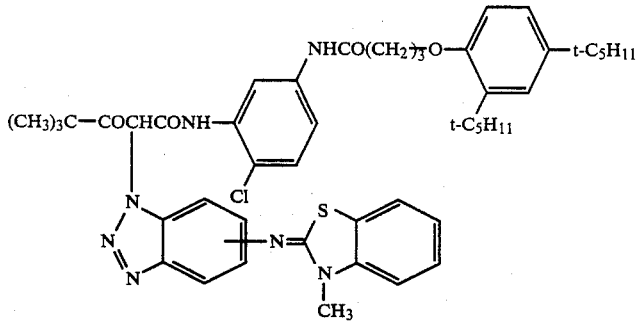
Coupler C-9:
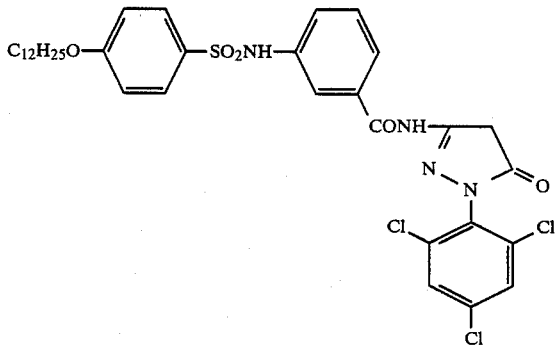
Coupler C-10:
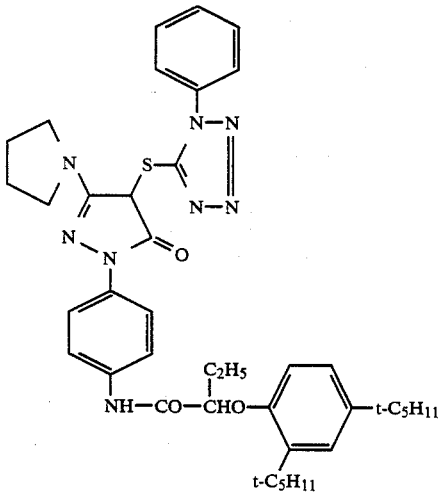
Coupler C-13:
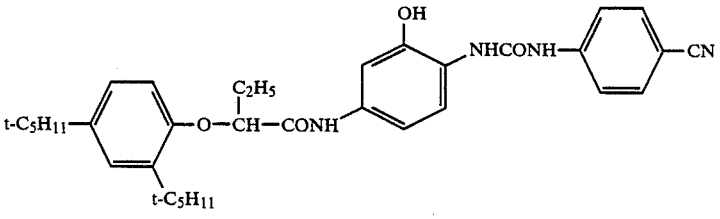
Coupler C-11:

-continued
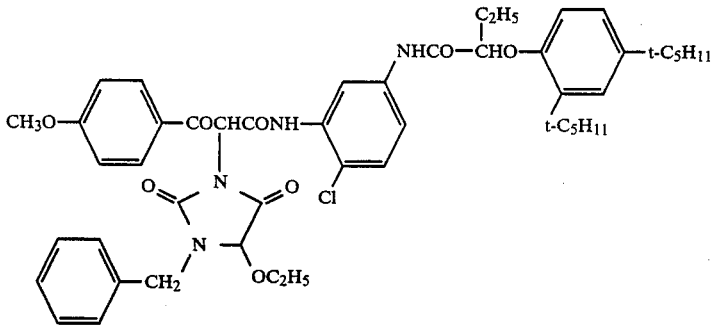
Coupler C-12:
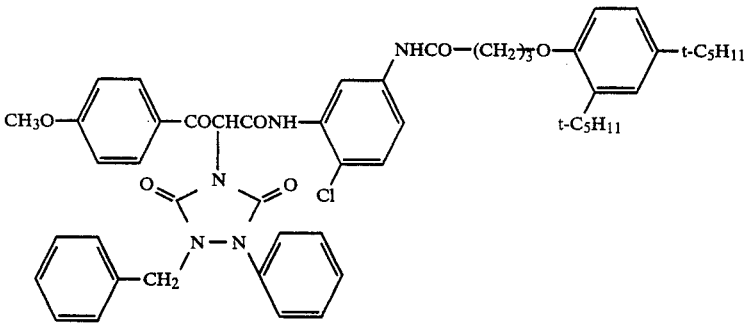
Surfactant W-1:
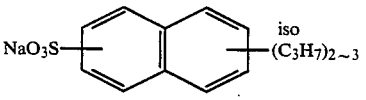
Film Hardener H-1:
$CH_2{=}CHSO_2CH_2CH_2SO_2CH{=}CH_2$
Formaldehyde Scavenger S-1:
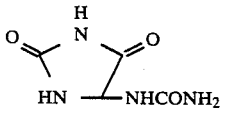
Dispersing Oil OIL-1:
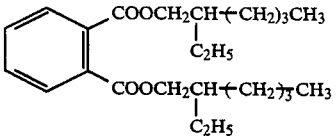
Dispersing Oil OIL-2:
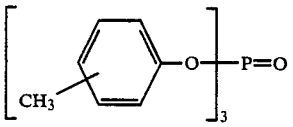
Dispersing Oil OIL-3:
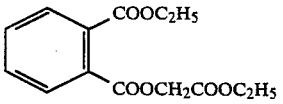
Ultraviolet Absorber UV-1:

-continued

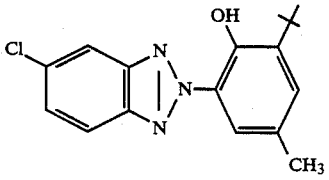

Ultraviolet Absorber UV-2:

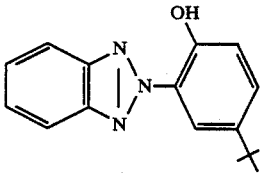

Ultraviolet Absorber UV-3:

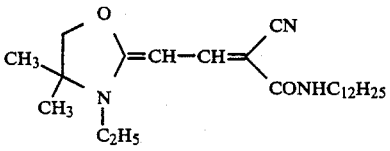

Compound Cpd-A:

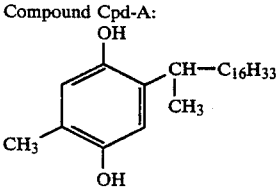

PREPARATION OF SAMPLE 102

DIR Compound C-5 of layers 10 and 11 of Sample 101 was replaced with an equimolar amount of DIR Compound D-10 as used in the present invention and DIR Compound C-10 of layers 6 and 7 was replaced with an equimolar amount of DIR Compound D-2 as used in the present invention. The material was subjected to white image exposure and blue, green and red separation exposures and the color development process described below. At this time the densities of the yellow image of the blue separation exposure and the magenta image of the green separation exposure were high and so Sample 102 was obtained by reducing the silver halide emulsion content in layers 10 and 11 and in layers 6 and 7 and matching the gradation.

PREPARATION OF SAMPLE 103

The yellow and magenta image densities of the blue and green separation exposures were high when the DIR compound C of layers 10 and 11 of Sample 101 was replaced with DIR Compound D-10 of this invention and DIR Compound C-10 in layers 6 and 7 was replaced with DIR Compound D-2 of this invention. Hence, the amounts of Yellow Coupler C-11 and Magenta Couplers C-7, C-8 and C-9 were each reduced by 10%. The amount of high boiling point organic solvent was also reduced by 10% accordingly and the amount of gelatin was reduced so that the ratios of the amounts of gelatin and the sums of the amounts of the couplers and high boiling point organic solvents (the oil-soluble component) were the same. When the adjustment could not be made in this way further adjustments were made by reducing the silver halide emulsion contents of layers 10 and 11 and layers 6 and 7 to provide Sample 103.

PREPARATION OF SAMPLE 104

Sample 104 was prepared in the same way as Sample 101 except that Yellow Coupler C-11 of layers 10 and 11 of Sample 101 was replaced with a 1.2 mol equivalent amount of Yellow Coupler Y-1 of this invention and the amount of DIR Compound C-5 was reduced by 20%.

PREPARATION OF SAMPLE 105

The DIR compound of layers 10 and 11 of Sample 104 was changed from C-5 to an equimolar amount of D-10 and the DIR compound of layers 6 and 7 was changed from C-10 to an equimolar amount of D-2 and white imagewise exposure and color separation exposures were made. On color development as described below the yellow density of the blue separation exposure and the magenta density of the green separation exposure where high and so the gradation was matched by reducing the amount of silver halide emulsion in layers 10 and 11 and in layers 6 and 7 to provide Sample 105.

PREPARATION OF SAMPLE 106

The yellow density of the blue separation exposure and the magenta density of the green separation exposure were high when DIR Compound C-5 of layers 10 and 11 in Sample 104 was replaced with D-10 and DIR Compound C-10 of layers 6 and 7 was replaced by D-2. Thus, the amounts of Yellow Coupler Y-1 and Magenta Couplers C-7, C-8 and C-9 used in these layers were each reduced by 10%. The amounts of high boiling point solvent were also reduced by 10% accordingly and the amounts of gelatin were also reduced to keep the ratios of the amounts of oil-soluble components and the amounts of gelatin constant. Where the adjustment could not be made in this way the gradation was matched by reducing the amounts of silver halide in layers 10 and 11 and in layers 6 and 7 to provide Sample 106.

PREPARATION OF SAMPLES 107 AND 108

Samples 107 and 108 were prepared in the same way as Sample 106 except that Yellow Coupler Y-1 of layers 10 and 11 of Sample 106 was replaced by an equimolar amount of Yellow Coupler Y-2 and Y-10 of this invention, respectively.

Samples 101 to 108 described above were exposed imagewise and color developed to evaluate their performance.

| Processing (38° C.) | Processing Time |
|---|---|
| Color Development | 3 min 15 sec |
| Bleach | 6 min 30 sec |
| Wash | 3 min 15 sec |
| Fix | 6 min 30 sec |
| Wash | 3 min 15 sec |
| Stabilization | 1 min 30 sec |

The compositions of the processing baths used in each of these processes were as indicated below.

| | |
|---|---|
| Color Developer Composition: | |
| 4-Amino-3-methyl-N-ethyl-N-(β-hydroxyethyl)aniline hydrochloride | 4.8 g |
| Anhydrous sodium sulfite | 0.14 g |
| Hydroxyamine hemisulfate | 1.98 g |
| Sulfuric acid | 0.74 g |
| Anhydrous potassium carbonate | 28.85 g |
| Anhydrous potassium bicarbonate | 3.46 g |
| Anhydrous potassium sulfite | 5.10 g |
| Potassium bromide | 1.16 g |
| Sodium chloride | 0.14 g |
| Nitrilotriacetic acid trisodium salt (monohydrate) | 1.20 g |
| Potassium hydroxide | 1.48 g |
| Water to make | 1 liter |
| Bleach Bath Composition: | |
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 ml |
| Water to make | 1 liter |
| The pH was adjusted to 6.0 with aqueous ammonia. | |
| Fixing Bath Composition: | |
| Ammonium thiosulfate | 175.0 g |
| Anhydrous sodium sulfite | 8.6 g |
| Sodium metasulfite | 2.3 g |
| Water to make | 1 liter |
| The pH was adjusted to 6.0 with acetic acid. | |
| Stabilizing Bath Composition: | |
| Formalin (37% aqueous solution) | 1.5 ml |
| "Konidax" (a product of Konica Co., Ltd.) | 7.5 ml |
| Water to make | 1 liter |

The MTF value at a frequency of 40 mines per millimeter of the magenta image and the granularity according to the normal RMS (root mean square) method of the yellow image were measured for these samples.

Moreover, the method used for the MTF measurement was that described on pages 604 to 607 of *The Theory of the Photographic Process*, Fourth Edition, by T. H. James (published by Macmillan, 1977).

The RMS method was that described in the paper entitled "RMS Granularity; Determination of Just Noticeable Differences" on pages 235 to 238 of *Photographic Science and Engineering*, Vol. 19, No. 4 (1975). An aperture of 48 μm was used.

The results of these measurements are summarized in Table 1.

The resistance to sweating was tested in the way indicated below. Sweating is the appearance of the oil-soluble components in the film in the form of droplets on the surface of the film, the material not being retained in the gelatin binder, when the light-sensitive material as left to stand under conditions of high temperature and humidity. The details of the test are described below.

Thus, strips of Samples 101 to 108 measuring 16 mm×120 mm were exposed to white image light and subjected to the aforementioned color development process and then they were left to stand for 1 week in a constant temperature, constant humidity vessel as 80° C., 40% R.H. The extent of any sweating was assessed in three stages as indicated below.

O : No change of the sample surface at all.

Δ: Not more than 10 fine oil droplets on the surface of the aforementioned sample.

×: More than 10 oil droplets on the surface of the aforementioned sample.

Color developed Samples 101 to 108 were irradiated with light from the emulsion side for a period of 75 hours in a fluorescent lamp fading tester (about 10,000 lux) in order to investigate the light stability of the yellow image and the retention of the colored image was expressed as a percentage (%) of the initial density.

The results obtained are summarized in Table 1.

Moreover, the film thicknesses of the multilayer silver halide light-sensitive materials in this invention were measured in the following way. A cross sectional photograph (magnification 3,000×) of the dried light-sensitive material was obtained using a scanning electron microscope and the thickness of each layer was calculated.

The thickness of the whole layer of dried material on the support was verified by measuring the thickness before and after the removal of the coated layers from the support, the measurements being made using a film thickness measuring gauge with contact type piezoelectric conversion elements. (Anritsu Electric Co., Ltd., K-402B STAND).

An aqueous solution of sodium hypochlorite was used to remove the coated emulsion layers from the support.

TABLE 1

| Sample No. | Yellow Coupler, Layers 10 & 11 | DIR Compound, Layers 10 & 11 | DIR Compound, Layers 6 & 7 | Thickness of Dry Film as Specified in the Invention (μm) | MTF of the Magenta Image | RMS of the Yellow Image | Sweating at the Film Surface | Light Fastness of the Yellow Image (colored image retention) (%) |
|---|---|---|---|---|---|---|---|---|
| Sample 101 | C-11 | C-5 | C-10 | 21 | 0.28 | 0.030 | O | 88 |

TABLE 1-continued

| Sample No. | Yellow Coupler, Layers 10 & 11 | DIR Compound, Layers 10 & 11 | DIR Compound, Layers 6 & 7 | Thickness of Dry Film as Specified in the Invention (μm) | MTF of the Magenta Image | RMS of the Yellow Image | Sweating at the Film Surface | Light Fastness of the Yellow Image (colored image retention) (%) |
|---|---|---|---|---|---|---|---|---|
| (comparison) | (Comparative coupler) | (comparative DIR compound) | (comparative DIR compound) | | | | | |
| Sample 102 (comparison) | C-11 (comparative coupler) | D-10 (DIR compound of the Invention) | D-2 (DIR compound of the Invention) | 20 | 0.30 | 0.032 | Δ | 85 |
| Sample 103 (comparison) | C-11 (comparative coupler) | D-10 (DIR compound of the Invention) | D-2 (DIR compound of the Invention) | 18 | 0.34 | 0.031 | x | 81 |
| Sample 104 (comparison) | Y-1 (coupler of this Invention) | C-5 (comparative DIR compound) | C-10 (comparative DIR compound) | 21 | 0.27 | 0.030 | O | 98 |
| Sample 105 (comparison) | Y-1 (coupler of this Invention) | D-10 (DIR compound of the Invention) | D-2 (DIR compound of the Invention) | 20 | 0.29 | 0.033 | O | 99 |
| Sample 106 (this Invention) | Y-1 (coupler of this Invention) | D-10 (DIR compound of the Invention) | D-2 (DIR compound of the Invention) | 18 | 0.35 | 0.032 | O | 98 |
| Sample 107 (this Invention) | Y-2 (coupler of this Invention) | D-10 (DIR compound of the Invention) | D-2 (DIR compound of the Invention) | 18 | 0.35 | 0.031 | O | 97 |
| Sample 108 (this Invention) | Y-10 (coupler of this Invention) | D-10 (DIR compound of the Invention) | D-2 (DIR compound of the Invention) | 18 | 0.35 | 0.032 | O | 98 |

EXAMPLE 2

Samples 201 to 209 were prepared on the basis of Sample 103 in Example 1 (film thickness 18 μm) using the methods described below.

The following dispersion methods were used.

Dispersion Method A:

100 g of coupler was heated and dissolved in 100 g of high boiling point organic solvent (tricresyl phosphate) (weight of coupler/weight of high boiling point organic solvent=1.0), 7 g of sodium dodecylbenzenesulfonate and 150 cc of ethyl acetate and the solution was mixed with 1,000 cc of an aqueous solution of gelatin (gelatin concentration 10%) and the mixture was emulsified by agitating at 15,000 rpm for 3 minutes at 60° C. in a homogenizer (emulsifier).

Dispersion Method B:

Emulsification was achieved in the same way as in Method A except that the amount of phosphate was reduced to 20 g (weight of coupler/weight of high boiling point organic solvent=0.2).

Dispersion Method C:

Emulsification was achieved in the same way as in Method A except that no tricresyl phosphate was used.

Dispersion Method D:

100 g of coupler, 40 g of ethyl acrylate, 10 of methyl methacrylate and 10 g of di-n-butyl phthalate were dissolved in 500 ml of ethyl acetate, 2 g of azobisisobutyronitrile was added as a polymerization initiator and the mixture was polymerized at 60° C. for 10 hours. After the reaction had been completed the reaction product was concentrated to 200 ml. This concentrate was added to 1,000 cc of an aqueous solution at 60° C. which contained 100 g of gelatin and 5 g of sodium dodecylbenzenesulfonate and the mixture was emulsified by vigorous mechanical agitation using an ultrasonic homogenizer.

PREPARATION OF SAMPLE 201

Sample 201 was prepared in the same way as Sample 103 in Example 1 except that Yellow Coupler C-11 in layers 10 and 11 of Sample 103 was emulsified using Dispersion Method A.

PREPARATION OF SAMPLE 202

Sample 202 was prepared in the same way as Sample 201 except that the dispersion of Yellow Coupler C-11 in layers 10 and 11 was carried out using Dispersion Method C.

PREPARATION OF SAMPLE 203

Sample 203 was prepared in the same way as Sample 201 except that the dispersion of Yellow Coupler C-11 in layers 10 and 11 was carried out using Dispersion Method D.

PREPARATION OF SAMPLE 204

Sample 204 was prepared in the same way as Sample 106 in Example 1 except that Yellow Coupler Y-1 in the layers 10 and 11 of Sample 106 was emulsified using Dispersion Method A.

PREPARATION OF SAMPLES 205, 206 and 207

Samples 205, 206 and 207 were prepared in the same way as Sample 204 except that the dispersion of the yellow coupler in layers 10 and 11 of Sample 204 was achieved using Dispersion Methods B, C and D.

PREPARATION OF SAMPLE 208

Sample 208 was prepared in the same way as Sample 206 except that Yellow Coupler Y-1 in layers 10 and 11 of Sample 206 was replaced by an equimolar quantity of Y-5.

PREPARATION OF SAMPLE 209

Sample 209 was prepared in the same way as Sample 207 except that Yellow Coupler Y-1 in layers 10 and 11 of Sample 207 was replaced by an equimolar quantity of Y-13.

The above-mentioned Samples 201 to 209 were subjected to a color development process and the results obtained in subsequent relative speed, sweating and scratch strength tests are summarized in Table 2.

The relative speeds are indicated as the relative speeds of the yellow images after white imagewise exposure.

The scratch tests were carried out by pressing a fine needle (0.05 mm) onto the film surface of the samples, sliding the needle under a continuous loading (0 to 200 g) and measuring the load required to scratch the film in order to investigate the film strength. Performance was assessed on the basis of the four stage indicated below. The numerical values are those at which the film started to be scraped.

◎: 150 to 200 g
○ : 100 to 150 g
Δ: 50 to 100 g
×: 0 to 50 g

PREPARATION OF SAMPLE 301

Yellow Coupler C-11 in layers 10 and 11 of Sample 101 in Example 1 was replaced with an equimolar quantity of C-12 and on carrying out white imagewise exposure and blue separation exposure and subjecting the sample to color development, the yellow image sensitivity was high and so the amount of silver halide was reduced to adjust the gradation to provide Sample 301. The total silver coated weight was 6.8 g/m$^2$.

PREPARATION OF SAMPLE 302

The yellow image sensitivity was low when Yellow Coupler C-1 in layers 10 and 11 of Sample 301 was replaced by a 1.1 mol equivalent quantity of Y-3 and so the amount of silver halide was increased to adjust the gradation to provide Sample 302. The total silver coated weight was 7.0 g/m$^2$.

PREPARATION OF SAMPLE 303

Yellow Coupler Y-1 in layers 10 and 11 of Sample 106 of Example 1 was replaced by an equimolar quantity of Y-3 and the gradation was adjusted by reducing the silver halide content of layers 10 and 11 to provide Sample 303. The total silver coated weight was 5.5 g/m$^2$.

PREPARATION OF SAMPLE 304

The yellow image sensitivity was high when Yellow Coupler Y-3 in layers 10 and 11 of Sample 303 was replaced with an equimolar quantity of Y-1 and so the amounts of silver halide were reduced to adjust the gradation to provide Sample 304. The total silver coated weight was 5.3 g/m$^2$.

TABLE 2

| Sample No. | Yellow Coupler, Layers 10 & 11 | DIR Compound, Layers 6 & 7 | Thickness of Dry Film as Specified in the Invention (μm) | Dispersion Method | Relative Speed of Yellow Image | Sweating | Scratch Strength |
|---|---|---|---|---|---|---|---|
| Sample 201 (comparison) | C-11 (comparative coupler) | D-2 (DIR compound of the Invention) | 18 | A | 120 | x | x |
| Sample 202 (comparison) | C-11 (comparative coupler) | D-2 (DIR compound of the Invention) | 17 | C | 80 | ○ | Δ |
| Sample 203 (comparison) | C-11 (comparative coupler) | D-2 (DIR compound of the Invention) | 18 | D | 85 | Δ | ○ |
| Sample 204 (the Invention) | Y-1 (coupler of the Invention) | D-2 (DIR compound of the Invention) | 18 | A | 105 | Δ | Δ |
| Sample 205 (the Invention) | Y-1 (coupler of the Invention) | D-2 (DIR compound of the Invention) | 18 | B | 100 | ○ | ○ |
| Sample 206 (the Invention) | Y-1 (coupler of the Invention) | D-2 (DIR compound of the Invention) | 17 | C | 95 | ○ | ◎ |
| Sample 207 (the Invention) | Y-1 (coupler of the Invention) | D-2 (DIR compound of the Invention) | 18 | D | 95 | ○ | ○ |
| Sample 208 (the Invention) | Y-5 (coupler of the Invention) | D-2 (DIR compound of the Invention) | 17 | C | 98 | ○ | ◎ |
| Sample 209 (the Invention) | Y-13 (coupler of the Invention) | D-2 (DIR compound of the Invention) | 18 | D | 94 | ○ | ○ |

EXAMPLE 3

Samples 301 to 304 which differed in coated silver weights (Ag weights) on the support were prepared and the photographic performance of these samples was evaluated.

The above-mentioned Samples 301 to 304 were subjected to white imagewise exposure and color development and the sharpness and granularity were assessed. The result obtained are summarized in Table 3.

Moreover, the amounts of silver were measured using fluorescence X-ray analysis.

TABLE 3

| Sample No. | Yellow Coupler, Layers 10 & 11 | DIR compound, Layers 10 & 11 | DIR Compound, Layers 6 & 7 | Thickness of Dry Film as Specified in the Invnetion (μm) | Coated Silver Weight ($g/m^2$) | MTF of the Magenta Image | RMS of the Yellow Image |
|---|---|---|---|---|---|---|---|
| Sample 301 (comparison) | C-12 (comparative coupler) | C-5 | C-10 | 22 | 6.8 | 0.27 | 0.30 |
| Sample 302 (comparison) | Y-3 (coupler of the Invention) | C-5 | C-10 | 21 | 7.0 | 0.28 | 0.29 |
| Sample 303 (the Invention) | Y-3 (coupler of the Invention) | D-10 | D-2 | 18 | 5.5 | 0.35 | 0.31 |
| Sample 304 (comparison) | Y-1 (coupler of the Invention) | D-10 | D-2 | 18 | 5.3 | 0.35 | 0.30 |

EXAMPLE 4

Samples 401 to 403 in which the amount of high boiling point organic solvent for the cyan coupler used in the red-sensitive layer was reduced in order to reduce the thickness of the film were prepared and the photographic performance of these samples was evaluated.

PREPARATION OF SAMPLE 401

Sample 401 was prepared in the same way as Sample 106 in Example 1 except that the high boiling point organic solvent OIL-1 and OIL-2 contents of the third layer of Sample 106 were set at 0.06 $g/m^2$, respectively. When this was done the weight ratio of the amounts of high boiling point organic solvent and coupler was 0.2.

PREPARATION OF SAMPLE 402

Sample 402 was prepared in the same way as Sample 401 except that the cyan coupler of layer 3 of Sample 401 was replaced with an equimolar quantity of Coupler LC-2 of this invention.

PREPARATION OF SAMPLE 403

Sample 403 was prepared in the same way as Sample 401 except that the cyan coupler of layer 3 of Sample 401 was replaced with an equimolar quantity of Comparative Coupler C-13.

One of each of Samples 401 to 403 was left to stand under conditions of constant temperature and humidity (25° C., 60% R.H.) for 3 days and then subjected to white imagewise exposure and color developed while another sample of each of Samples 401 to 403 was left to stand under conditions of constant temperature and humidity (45° C., 80% R.H.) for 3 days and then exposed and developed in the same way as before and the differences (speed difference; $\Delta S_{0.5}$) were investigated. Furthermore, samples of Samples 401 to 403 were stored in a freezer for about 3 months and then exposed and developed in the same way as before and on examining the state of the dyes in these sample films using a microscope it was found that they had crystallized in part.

The results obtained are summarized in Table 4.

TABLE 4

| Sample No. | Cyan Coupler in Layer 3 | Difference in Sensitivity after 3 Days at 45° C., 80% RH to 25° C., 60% RH | Precipitation of Dye in Film on Processing after Storage for 3 Months in a Freezer |
|---|---|---|---|
| Sample 401 (this Invention) | C-2 (coupler of this Invention) | +0.05 | No precipitation |
| Sample 402 (this Invention) | LC-2 (coupler of this Invention) | +0.06 | No precipitation |
| Sample 403 (comparison) | C-13 (comparative coupler) | +0.20 | Precipitation of dye in some oil droplets |

It is clear from Table 1 that the samples in which the DIR compound and yellow coupler of this invention are used conjointly and in which the layer thickness has been reduced have improved sharpness, that they are not liable to sweating and that they have excellent colored image retention properties.

It is clear from Table 2 that it is possible to reduce the layer thickness and to suppress film property deterioration using a dispersion method in which the amount of high boiling point organic solvent is reduced or a dispersion method in which a polymer is used as a means of realizing the effect of the invention.

Moreover, it is clear from Table 3 that marked economy in silver usage can be achieved.

It is clear from Table 4 that the cyan couplers of this invention provide stable photographic properties and storage properties even with small amounts of low boiling point organic solvents.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon one or more blue-sensitive layers each containing a yellow coupler, one or more green-sensitive layers each containing a magenta coupler, one or more red-sensitive layers each containing a cyan coupler and one or more protective layers provided on the side of the support and further from the support than the color-sensitive layer which is furthest away from the support, the thickness of the total photographic layers provided on the support from the color-sensitive layer located closest to the support to the protective layers, inclusive, being 18 μm or less, wherein at least one of said yellow coupler is a compound represented by formula (I)

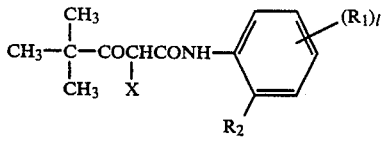

(I)

wherein $R_1$ represents a halogen atom, an aliphatic group, an aromatic group, an aliphatic oxy group, an aromatic oxy group, a carboxylamido group, a sulfonamido group, a carbamoyl group, a sulfamoyl group, an acyloxy group, a substituted amino group, an aliphatic thio group, a ureido group, a sulfamoylamino group, a cyan group, an aliphatic oxycarbonyl group, an aliphatic oxycarbonylamino group, an imido group, an aliphatic sulfonyl group, an aromatic sulfonyl group or a heterocyclic group; $R_2$ represents a hydrogen atom, a halogen atom or an aliphatic oxy group; X represents a hydrogen atom or a group which is eliminated by a coupling reaction with the oxidized form of a primary aromatic amine based developing agent; l represents 0 or an integer of from 1 to 4; and wherein said light-sensitive photographic material further contains a compound represented by formula (II)

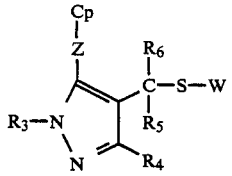

(II)

wherein Cp represents a coupling component which is able to react with the oxidized form of a primary aromatic amine based developing agent; $R_3$ represents a hydrogen atom, an alkyl group, an aryl group, an acyl group, a sulfonyl group, an alkoxycarbonyl group or a heterocyclic group; $R_4$ represents a hydrogen atom, an alkyl group, an aryl group, an alkoxy group, an amino group, a carboxylamido group, a sulfonamido group, a carboxyl group, an alkoxycarbonyl group, a carbamoyl group or a cyano group; $R_5$ and $R_6$ each represents individually hydrogen atoms, alkyl groups or aryl groups; W represents a group which forms, together with the sulfur atom when the thioether bond is eliminated, a compound which has a development inhibiting action; and Z is bonded to the coupling position of Cp and represents an —O— group, an —S— group or an

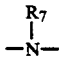

group, wherein $R_7$ represents a hydrogen atom, an alkyl group, an acyl group or a sulfonyl group, wherein the amount of silver contained in the light-sensitive material is 5.5 g/m$^2$ or less and wherein the amount of silver iodide in the silver halide contained in the light-sensitive material is 2 to 40 mol %, and wherein at least one of said yellow, magenta and cyan couplers is incorporated by using a dispersion method in which a high boiling point solvent as the coupler dispersion medium is dispersed in an amount such that the weight ratio with respect to the coupler is not more than 0.2.

2. A silver halide color photographic light-sensitive material as in claim 1, wherein at least one of the yellow, magenta and cyan couplers is incorporated by using a dispersion method by means of a polymer dispersion in which a macromolecular polymer (polymer) is used as the coupler dispersion medium.

3. A silver halide color photographic light-sensitive material as in claim 1, wherein the weight ratio of the high boiling point organic solvent to coupler is not more than 0.1.

4. A silver halide color photographic light-sensitive material comprising a support having provided thereon one or more blue-sensitive layers each containing a yellow coupler, one or more green-sensitive layers each containing a magenta coupler, one or more red-sensitive layers each containing a cyan coupler and one or more protective layers provided on the side of the support and further from the support than the color-sensitive layer which is furthest away from the support, the thickness of the total photographic layers provided on the support from the color-sensitive layer located closest to the support to the protective layers, inclusive, being 18 μm or less, wherein at least one of said yellow coupler is a compound represented by formula (I)

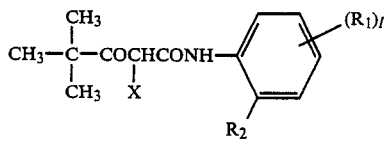

(I)

wherein $R_1$ represents a halogen atom, an aliphatic group, an aromatic group, an aliphatic oxy group, an aromatic oxy group, a carboxylamido group, a sulfonamido group, a carbamoyl group, a sulfamoyl group, an acyloxy group, a substituted amino group, an aliphatic thio group, a ureido group, a sulfamoylamino group, a cyan group, an aliphatic oxycarbonyl group, an aliphatic oxycarbonylamino group, an imido group, an aliphatic sulfonyl group, an aromatic sulfonyl group or a heterocyclic group; $R_2$ represents a hydrogen atom, a halogen atom or an aliphatic oxy group; X represents a hydrogen atom or a group which is eliminated by a coupling reaction with the oxidized form of a primary aromatic amine based developing agent; l represents 0 or an integer of from 1 to 4; and wherein said light-sensitive photographic material further contains a compound represented by formula (II)

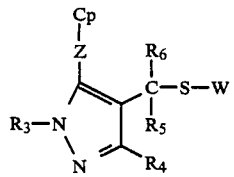

(II)

wherein Cp represents a coupling component which is able to react with the oxidized form of a primary aromatic amine based developing agent; $R_3$ represents a hydrogen atom, an alkyl group, an aryl group, an acyl group, a sulfonyl group, an alkoxycarbonyl group or a heterocyclic group; $R_4$ represents a hydrogen atom, an alkyl group, an aryl group, an alkoxy group, an amino group, a carboxylamido group, a sulfonamido group, a carboxyl group, an alkoxycarbonyl group, a carbamoyl group or a cyano group; $R_5$ and $R_6$ each represents individually hydrogen atoms, alkyl groups or aryl groups; W represents a group which forms, together with the sulfur atom when the thioether bond is eliminated, a compound which has a development inhibiting action; and Z is bonded to the coupling position of Cp and represents an —O— group, an —S— group or an

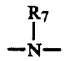

group, wherein $R_7$ represents a hydrogen atom, an alkyl group, an acyl group or a sulfonyl group, wherein the amount of silver contained in the light-sensitive material is 5.5 g/m$^2$ or less and wherein the amount of silver iodide in the silver halide contained in the light-sensitive material is 2 to 40 mol %, and wherein at least one of said yellow, magenta and cyan couplers is incorporated by using a dispersion method by means of a polymer dispersion in which a macromolecular polymer (polymer) is used as the coupler dispersion medium.

5. A silver halide color photographic light-sensitive material as in claims 1 or 4 wherein the yellow coupler is added to the silver halide layer or to an emulsion layer adjacent to said silver halide layer in an amount of from 1 to 50 mol % per mol of silver halide in said silver halide layer.

6. A silver halide color photographic light-sensitive material as in claims 1 or 4, wherein the cyan coupler is represented by general formula (III)

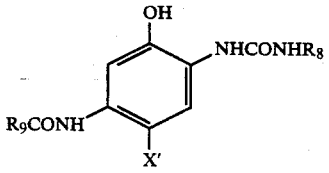

(III)

wherein $R_8$ represents an aryl group or a heterocyclic group; $R_9$ represents a ballast group; and X′ represents a hydrogen atom or a group which can be eliminated by means of a coupling reaction with the oxidized form of a primary aromatic amine-based developing agent.

7. A silver halide color photographic light-sensitive material as in claim 1 or 4, wherein X is represented by general formula (IV)

$$-O-R_{10} \quad (IV)$$

wherein $R_{10}$ is an aromatic group which has from 6 to 40 carbon atoms, a heterocyclic group which has from 1 to 40 carbon atoms, an acyl group which has from 2 to 40 carbon atoms, an aliphatic sulfonyl group which has from 1 to 40 carbon atoms or an aromatic sulfonyl group which has from 6 to 40 carbon atoms.

8. A silver halide color photographic light-sensitive material as in claims 1 or 4, wherein X is represented by general formula (V)

$$-S-R_{11} \quad (V)$$

wherein $R_{11}$ is an aliphatic group which has from 1 to 40 carbon atoms, an aromatic group which has from 6 to 40 carbon atoms or a heterocyclic group which has from 1 to 40 carbon atoms.

9. A silver halide color photographic light-sensitive material as in claims 1 or 4, wherein X is represented by general formula (VI)

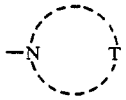

(VI)

wherein T represents a nonmetallic atomic group which forms a 5- to 7-membered single or condensed heterocyclic ring with the nitrogen.

10. A silver halide color photographic light-sensitive material as in claims 1 or 4, wherein the amount of silver iodide in the silver halide contained in the light-sensitive material is 5 to 20 mol %.

* * * * *